US007116301B2

(12) United States Patent
Numao

(10) Patent No.: US 7,116,301 B2
(45) Date of Patent: Oct. 3, 2006

(54) DRIVING DEVICE FOR ELECTRO-OPTIC DEVICE, DISPLAY DEVICE USING THE DRIVING DEVICE, DRIVING METHOD THEREOF, AND WEIGHT DETERMINATION METHOD THEREOF

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 345 days.

(21) Appl. No.: 10/396,425

(22) Filed: Mar. 26, 2003

(65) Prior Publication Data

US 2003/0197667 A1 Oct. 23, 2003

(30) Foreign Application Priority Data

Apr. 9, 2002 (JP) ..... 2002-107109
Dec. 6, 2002 (JP) ..... 2002-355547

(51) Int. Cl.
*G09G 3/36* (2006.01)
*G09G 5/10* (2006.01)

(52) U.S. Cl. ..... 345/89; 345/692

(58) Field of Classification Search ..... 345/89–93, 345/204, 690–693
See application file for complete search history.

(56) References Cited

U.S. PATENT DOCUMENTS 5,737,038 A * 4/1998 Gale et al. ..... 348/759
5,831,586 A * 11/1998 Hirai et al. ..... 345/94
5,969,701 A * 10/1999 Numao et al. ..... 345/89
5,969,713 A 10/1999 Tomizawa et al.
6,433,763 B1 * 8/2002 Lim et al. ..... 345/68
6,448,960 B1 * 9/2002 Shigeta ..... 345/204
6,542,135 B1 * 4/2003 Kasahara et al. ..... 345/63
6,583,576 B1 * 6/2003 Koyama ..... 315/169.2

FOREIGN PATENT DOCUMENTS

EP 0 261 901 A2 3/1988
JP 6-148616 5/1994
JP 11-176580 7/1999

OTHER PUBLICATIONS

Japanese KOKAI No. 231359/2000 (Published unexamined patent application) (Tokukai 2000-231359, Published Date: Aug. 22, 2000), including Abstract and Translation of the relevant passages.

(Continued)

*Primary Examiner*—Richard Hjerpe
*Assistant Examiner*—M. Fatahiyar
(74) *Attorney, Agent, or Firm*—Nixon & Vanderhye, PC

(57) ABSTRACT

When time division gradation display is carried out by setting a display state of an electro-optic element capable of R-gradation display A times in one frame period, the present invention determines the weights of the bit data to be such as $2^0:2^1:2^2:2^{3-1}: \ldots$, in which a conventional ratio regulation of $2^0:2^1:2^2:2^3: \ldots$ i.e., 1:2:4:8: . . . is changed by at least one part at or later the third bit so as to satisfy the relation of $B<R^A$ where B expresses the number of display gradations. With this arrangement, it is possible to realize the time division gradation display with a desirable number of scanning lines and the desirable bit weight ratio, without significantly changing the actually-recognized image. On this account, the range of the electro-optic device, capable of setting each stage of outputs in the frame period to be a desirable value, can be enlarged with respect to a matrix display device using the time division gradation display.

27 Claims, 30 Drawing Sheets

OTHER PUBLICATIONS

Japanese KOKAI No. 221942/2000 (Published unexamined patent application) (Tokukai 2000-221942, Published Date: Aug. 11, 2000), including Abstract and Translation of the relevant passages.

Japanese KOKAI No. 242827/2001 (Published unexamined patent application) (Tokukai 2001-242827, Published Date: Sep. 7, 2001, including Abstract and Translation of the relevant passages.

* cited by examiner

FIG. 3

| | | NUMBER OF OCCUPIED TIME | | | | |
|---|---|---|---|---|---|---|
| BIT NUMBER | WEIGHT OF BIT | 0 | 1 | 2 | 3 | 4 |
| 1 | 2 | ● | | | | |
| 2 | 4 | | | ● | | |
| 3 | 8 | | ● | | | |
| 4 | 14 | | | | | ● |
| 5 | 22 | | | | ● | |
| | | ● | | | | |

FIG. 5

| | | NUMBER OF OCCUPIED TIME | | | | |
|---|---|---|---|---|---|---|
| BIT NUMBER | WEIGHT OF BIT | 0 | 1 | 2 | 3 | 4 |
| 1 | 3 | ● | | | | |
| 2 | 6 | | | | ● | |
| 3 | 12 | | | | | ● |
| 4 | 21 | | ● | | | |
| B | 0 | | | ● | | |

FIG. 7

| | | NUMBER OF OCCUPIED TIME | | | | | | |
|---|---|---|---|---|---|---|---|---|
| BIT NUMBER | WEIGHT OF BIT | 0 | 1 | 2 | 3 | 4 | 5 | 6 |
| 1 | 32 | ● | | | | | | |
| 2 | 64 | | | | | ● | | |
| 3 | 96 | | | | | | ● | |
| 4 | 192 | | | | ● | | | |
| 5 | 416 | | | | | | | ● |
| 6 | 832 | | | ● | | | | |
| B | 0 | | ● | | | | | |

FIG. 8

| | | NUMBER OF OCCUPIED TIME | | | | | | | | |
|---|---|---|---|---|---|---|---|---|---|---|
| BIT NUMBER | WEIGHT OF BIT | 0 | 1 | 2 | 3 | 4 | 5 | 6 | 7 | 8 |
| 1 | 17 | ● | | | | | | | | |
| 2 | 34 | | | | | | | | | ● |
| 3 | 68 | | | | | | | ● | | |
| 4 | 136 | | | ● | | | | | | |
| 5 | 272 | | | | ● | | | | | |
| 6 | 527 | | | | | | ● | | | |
| 7 | 1020 | | ● | | | | | | | |
| 8 | 2091 | | | | | ● | | | | |
| B | 0 | | | | | | | | ● | |

FIG. 9

| | | NUMBER OF OCCUPIED TIME | | | | | |
|---|---|---|---|---|---|---|---|
| BIT NUMBER | WEIGHT OF BIT | 0 | 1 | 2 | 3 | 4 | 5 |
| 1 | 1 | ● | | | | | |
| 2 | 2 | | ● | | | | |
| 4 | 7 | | | | ● | | |
| 3 | 4 | | | | | ● | |
| 5 | 15 | | | ● | | | |
| 6 | 25 | | | | | | ● |
| | | ● | | | | | |

FIG. 10

| | | NUMBER OF OCCUPIED TIME | | | | | | | |
|---|---|---|---|---|---|---|---|---|---|
| BIT NUMBER | WEIGHT OF BIT | 0 | 1 | 2 | 3 | 4 | 5 | 6 | 7 |
| 1 | 1 | ● | | | | | | | |
| 2 | 2 | | ● | | | | | | |
| 3 | 4 | | | | ● | | | | |
| 4 | 7 | | | | | | | | ● |
| 5 | 15 | | | | | | | ● | |
| 6 | 29 | | | | | | ● | | |
| 7 | 58 | | | ● | | | | | |
| 8 | 116 | | | | | ● | | | |
| | | ● | | | | | | | |

FIG. 11

| | | NUMBER OF OCCUPIED TIME | | | | | | |
|---|---|---|---|---|---|---|---|---|
| BIT NUMBER | WEIGHT OF BIT | 0 | 1 | 2 | 3 | 4 | 5 | 6 |
| 1 | 1 | ● | | | | | | |
| 2 | 2 | | ● | | | | | |
| 4 | 8 | | | | ● | | | |
| 5 | 15 | | | | | ● | | |
| 3 | 4 | | | | | | ● | |
| 6 | 25 | | | ● | | | | |
| B | 0 | | | | | | | ● |

FIG. 12

| | | NUMBER OF OCCUPIED TIME | | | | | | |
|---|---|---|---|---|---|---|---|---|
| BIT NUMBER | WEIGHT OF BIT | 0 | 1 | 2 | 3 | 4 | 5 | 6 |
| 5 | 16 | ● | | | | | | |
| 2 | 2 | | | ● | | | | |
| 4 | 8 | | | | | ● | | |
| 1 | 1 | | | | | | ● | |
| 3 | 4 | | | | | | | ● |
| 6 | 26 | | | | ● | | | |
| B | 0 | | ● | | | | | |

FIG. 15

| | | NUMBER OF OCCUPIED TIME | | | | | | | | |
|---|---|---|---|---|---|---|---|---|---|---|
| BIT NUMBER | WEIGHT OF BIT | 0 | 1 | 2 | 3 | 4 | 5 | 6 | 7 | 8 |
| 7 | 62 | ● | | | | | | | | |
| 6 | 31 | | | | | | | | | ● |
| 5 | 16 | | | | ● | | | | | |
| 3 | 4 | | ● | | | | | | | |
| 4 | 8 | | | | | | ● | | | |
| 2 | 2 | | | | | ● | | | | |
| 1 | 1 | | | | | | | ● | | |
| 8 | 94 | | | | | | | | ● | |
| B | 0 | | | ● | | | | | | |

FIG. 22

| | | NUMBER OF OCCUPIED TIME | |
|---|---|---|---|
| BIT NUMBER | WEIGHT OF BIT | 0 | 1 |
| 1 | 3 | ● | |
| 2 | 9 | | ● |

FIG. 24

| | | NUMBER OF OCCUPIED TIME | | |
|---|---|---|---|---|
| BIT NUMBER | WEIGHT OF BIT | 0 | 1 | 2 |
| 1 | 4 | ● | | |
| 2 | 16 | | ● | |
| B | 0 | | | ● |

FIG. 25

1 FRAME PERIOD

| | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|
| (1) SELECTION TIME | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 1 | 2 | 3 |
| (2) UNIT TIME | 1 | | | 2 | | | 3 | | | 4 | | | 5 | | | 6 | | | 7 | | | 8 | | | 9 | | | 10 | | | 1 | | |
| (3) OCCUPIED TIME | 0 | 1 | 2 | 0 | 1 | 2 | 0 | 1 | 2 | 0 | 1 | 2 | 0 | 1 | 2 | 0 | 1 | 2 | 0 | 1 | 2 | 0 | 1 | 2 | 0 | 1 | 2 | 0 | 1 | 2 | 0 | 1 | 4 |
| (4) G1 | 1 | | | | 2 | | | | | | | | | | | | | | | | B | | | | | | | | | | 1 | | |
| (5) G2 | | | | 1 | | | | 2 | | | | | | | | | | | | | | | | B | | | | | | | | | |
| (6) G3 | | | | | | | 1 | | | | 2 | | | | | | | | | | | | | | | | B | | | | | | |
| (7) G4 | | | | | | | | | | 1 | | | | 2 | | | | | | | | | | | | | | | | B | | | |
| (8) G5 | | | B | | | | | | | | | | 1 | | | | 2 | | | | | | | | | | | | | | | | B |
| (9) G6 | | | | | | B | | | | | | | | | | 1 | | | | 2 | | | | | | | | | | | | | |
| (10) G7 | | | | | | | | | B | | | | | | | | | | 1 | | | | 2 | | | | | | | | | | |
| (11) G8 | | | | | | | | | | | | B | | | | | | | | | | 1 | | | | 2 | | | | | | | |
| (12) G9 | | | | | | | | | | | | | | | B | | | | | | | | | | 1 | | | | 2 | | | | |
| (13) G10 | | 2 | | | | | | | | | | | | | | | | B | | | | | | | | | | 1 | | | | 2 | |

4 16

FIG. 26

| | | NUMBER OF OCCUPIED TIME | | | |
|---|---|---|---|---|---|
| BIT NUMBER | WEIGHT OF BIT | 0 | 1 | 2 | 3 |
| 2 | 3 | ● | | | |
| 3 | 10 | | | | ● |
| 1 | 1 | | ● | | |
| B | 0 | | | ● | |

FIG. 29

| | | NUMBER OF OCCUPIED TIME | | | | | | | | |
|---|---|---|---|---|---|---|---|---|---|---|
| BIT NUMBER | WEIGHT OF BIT | 0 | 1 | 2 | 3 | 4 | 5 | 6 | 7 | 8 |
| 1 | 1 | ● | | | | | | | | |
| 3 | 4 | | ● | | | | | | | |
| 5 | 16 | | | | | | ● | | | |
| 4 | 8 | | | | ● | | | | | |
| 2 | 2 | | | ● | | | | | | |
| 6 | 31 | | | | | ● | | | | |
| 7 | 62 | | | | | | | | | ● |
| 8 | 125 | | | | | | | | ● | |
| B | 0 | | | | | | | ● | | |

DRIVING DEVICE FOR ELECTRO-OPTIC DEVICE, DISPLAY DEVICE USING THE DRIVING DEVICE, DRIVING METHOD THEREOF, AND WEIGHT DETERMINATION METHOD THEREOF

FIELD OF THE INVENTION

The present invention relates to a driving device for driving an electro-optic device having electro-optic elements capable of R-stage outputs (R is an integer not less than 2), so as to cause each electro-optic element to output more than once in one frame period; and a display device using time division gradation display in which display states of the electro-optic element capable of R-gradation (R is an integer not less than 2) display are switched more than once in one frame period so as to realize B-gradation (B is an integer satisfying B>R) display; and also relates to a driving method thereof, and further relates to a data weight determination method thereof.

BACKGROUND OF THE INVENTION

In a display device using ferroelectric liquid crystal or plasma display as the electro-optic element, the obtained luminance condition of the display device often varies due to variation of condition such as a manufacturing condition of each electro-optic element, even though the supplied voltage or pulse width is identical. Particularly, in a matrix-type display device whose pixels are adjacently aligned, the variation of the luminance condition greatly affects the display quality. For this reason, in a display device using a driving method of setting one display state in one frame period, there is a difficulty to obtain a required display quality in such electro-optic elements.

In view of the foregoing problem, a conventional matrix-type display device using such electro-optic elements is arranged to perform time division gradation display, which carries out switching of display state of an electro-optic element capable of finite R-gradation display, so that the display state changes more than once in one frame period and therefore realizes a desired B-gradation (B>R) display. For example, here, an extreme example of the time division gradation display is referred for ease of understanding. According to the example, one frame period is equally divided by two, and electro-optic elements (R=2) capable of 2-gradation display are independently controlled their lighting in the first half period and the second half period, so as to realize 3-gradation display (this provides light quantity levels of 0, 1, 2, i.e., B=3). Further, since this time division gradation display does not decrease fineness of the display, it is effective to realize multi-gradation display.

FIG. 16 is a drawing showing a driving method disclosed in a patent document 1 (EPA0261901A2: published on Mar. 30, 1988), which is a typical conventional technology for realizing such a time division gradation display. The configuration of the patent document 1 adopts ferroelectric liquid crystal as an electro-optic element, and the respective electro-optic elements carry out 2-gradation display (R=2), and further, each of the display state is switched 4 times in one frame period so as to realize 16-gradation display (B=16). The example of FIG. 16 assumes a matrix-type display device in which 15 scanning lines (G1 through G15) are controlled together as one group. Hereinafter, 4 bits data displayed in each electro-optic element will be respectively referred to as first bit data, second bit data, third bit data, and fourth bit data, in order-of lighter to heavier in the weight of data.

The horizontal axis of the figure denotes time, and (1) denotes total time of selection time, having a minimum unit, and 60 selection times make up one frame period. (2) denotes the time, which is obtained by dividing the one frame period into control units, and one frame period includes 15 unit times. Further, (3) denotes occupied time of each bit data in the unit time, i.e., timing slots for practically outputting each bit data to a data line. The occupied time is made up of 4 slots (1 through 4). Further, (4) through (18), which denote the data displayed in the respective scanning lines G1 through G15, and a number "1" is shown when the first bit data is displayed, a number "2" is shown when the second bit data is displayed, a number "3" is shown when the third bit data is displayed, and a number "4" is shown when the fourth bit data is displayed, as the data firstly displayed in the display period of each data.

Accordingly, in the scanning line G1, for example, operation of 1 frame is carried out in such a manner that: the scanning line G1 is firstly selected the first occupied time of the first unit time, and the first bit data is displayed during the first selection time through the fifth selection time, then the G1 is secondly selected in the second occupied time of the second unit time, and the second bit data is displayed during the sixth selection time through the fourteenth selection time, then the G1 is thirdly selected in the third occupied time of the fourth unit time, and the third bit data is displayed during the fifteenth selection time through the thirty first selection time, and further, the G1 is lastly selected in the fourth occupied time of the eighth unit time, and the fourth data is displayed during the thirty second selection time through the sixty fourth selection time.

However, in this configuration of the patent document 1, respective weights of the first through fourth bits are 1:2:4:8 in the unit time; and are 5:9:17:29 in the selection time, which shows some errors especially in lower bits. Thus, there arises a problem of inadequate accuracy. Further, the number of the scanning lines is always required to be $\Sigma 2^K-1$ (k=0, 1, 2) in each group so as to realize this arrangement.

In this point of view, another patent document (patent document 2; U.S. Pat. No. 5,969,713: issued on Oct. 19, 1999) will be explained as an example for solving the foregoing problem. FIG. 17 is a drawing showing a driving method described in Example 1 of the patent document 2. In this configuration of the patent document 2, each electro-optic element is made up of two partial pixels having area ratio of 1:2, and the respective electro-optic elements carry out 2-gradation display so as to realize 4-gradation display (R=4), and further, each of the display state is switched 3 times in one frame period so as to realize 64-gradation display. The example of FIG. 17 assumes a matrix-type display device in which scanning lines G1 through G7 are controlled as one group.

The horizontal axis of the figure denotes time, and (1) denotes total time of selection time (a minimum unit), and 21 selection times make up one frame period. (2) denotes unit time, which is decided by dividing the one frame period into control units, and one frame period includes 7 unit times. Further, (3) denotes occupied time of each bit data in the unit time. The occupied time is made up of 3 slots (1 through 3). Further, (4) through (10), which denote the data displayed in the respective scanning lines G1 through G7.

Accordingly, in the scanning line G1, for example, operation of 1 frame is carried out in such a manner that: the scanning line G1 is firstly selected in the first occupied time of the first unit time, and the first bit data is displayed only in the first selection time since the G1 is secondly selected in the second occupied time of the first unit time; and then the second bit data is displayed during the second selection time through the fifth selection time since the G1 is thirdly selected in the third occupied time of the second unit time, and the third bit data is displayed in the sixth selection time through the twenty first selection time.

In terms of the selection time, this manner realizes gradation display in which the display term ratio of 1:4:16 with respect to each bit is accurately consistent with the weight of the bit.

Further, FIG. 18 is a drawing showing a driving method described in Example 2 of the patent document 2. In this configuration, each electro-optic element carries out two gradations display (R=2), and each of the display state is switched 3 times in one frame period. The example of FIG. 18 assumes a matrix-type display device in which scanning lines G1 through G8 are controlled as one group.

The horizontal axis of the figure denotes time, and (1) denotes the total time, and 24 selection times make up one frame period. (2) denotes the unit time, and one frame period includes 8 unit times. Further, (3) denotes the occupied time, which is made up of 3 slots (1 through 3). Further, (4) through (11), which denote the data displayed via the respective scanning lines G1 through G8.

Accordingly, in the scanning line G1, for example, operation of 1 frame is carried out in such a manner that: the scanning line G1 is firstly selected in the first occupied time of the first unit time, and the first bit data is displayed in the first selection time through the third selection time, then the G1 is secondly selected in the second occupied time of the second unit time, and the second bit data is displayed in the fifth selection time through the tenth selection time, then the G1 is thirdly selected in the third occupied time of the fourth unit time, and the third bit data is displayed in the twelfth selection time through the twenty third selection time. Further, blank data denoted by "B" is written in an occupied time before the occupied time where each bit data is set, apart from data condition of the data line, so as to carry out initialization by deleting all data of electro-optic elements which have been displayed.

As a result, the difference between (a) 24 selection times (8 scanning lines×3 numbers of bit) making up one frame period and (b) total display period of the first through third bit data, i.e., 21 selection times (=3+6+12) is provided as a blanking period, during which a non-display state occurs.

In terms of the selection time, this manner realizes gradation display in which the display term ratio 3:6:12=1:2:4=$2^0$:$2^1$:$2^2$ of each bit is accurately consistent with the weight of the bit.

Furthermore, gradation display of 1:2:4:8 is disclosed in other examples of the patent document 2, and they also describe an arrangement in which each period from the initialization by the blank data "B" to a display of the next bit data is increased to be 2 selection times or more, or, the period varies depending on the respective bits, so as to carry out group control for an arbitrary number of signal line other than multiples of 8. As thus described, by using the driving method disclosed in the patent document 2, it is possible to obtain a display term ratio proportional to the weight of each bit.

However, even though each gradation level in one frame period may be set to be a target one, the configuration of the patent document 2 has a problem of limitation of the number of scanning lines, or the arrangement of electro-optic elements.

More specifically, in the configuration disclosed in Example 1 of the patent document 2, when a gradation number displayable in one pixel is set to be R=4, the weight of each bit will be such as the foregoing ratio of 1:4:16 (1:R:$R^2$), and therefore (the number of scanning lines×the number of bits) has to be a multiple of 21 (=1+4+16). In this point of view, since the other examples, i.e., the Example 2 and later examples adopt blank scanning, it is not required to limit (the number of scanning lines)×(the number of bits/$\Sigma R''$ (summation of $R''$ (R: weight ratio)) to be an integer. However, those examples have a different limit of requirement of initialization scanning, which has to be carried out apart from the scanning for writing display data.

Here, the patent document 2 deals with a case of using ferroelectric liquid crystal as an electro-optic element, and therefore there are no difficulties to set the blank scanning. However, in the case of using other types of liquid crystal, such as TN (Twisted Nematic) liquid crystal, or in the case of using organic EL (Electro Luminescence), the arrangement requiring the blank scanning cannot be adopted. This gives rise to a problem.

To be more specific, in the ferroelectric liquid crystal, the liquid crystal is driven by a simple matrix driving and the blank display (initialization) can be realized by applying a voltage of negative polarity to a scanning line. Thus, it is possible to simultaneously select a scanning line for writing bit data for display, and a scanning line for the initialization. For example, in FIG. 18, in the first occupied time of the first unit time, the scanning line G1 is selected for the writing of data and therefore supplied with a voltage of positive polarity, and the scanning line G8 is selected for the initialization and therefore supplied with the voltage of negative polarity. In this manner, the blank scanning can easily be set without increasing the selection time.

On the other hand, in the case of using such as TN liquid crystal or organic EL, the initialization cannot be carried out in an asynchronous state only by changing the voltage applied to a scanning line. Thus, the TN liquid crystal or the organic EL requires an initialization TFT (Thin Film Transistor) for each electro-optic element, as disclosed in Japanese Laid-Open Patent Application Tokukai 2000-221942, or in Japanese Laid-Open Patent Application Tokukai 2001-242827, so as to carry out initialization scanning apart from the scanning for the writing of bit data for display. FIGS. 19 and 20 show this arrangement.

FIG. 19 shows an example of using liquid crystal other than the ferroelectric liquid crystal, as an electro-optic element. In this example, each bit data is outputted to a source line Sj, and supplied to an electro-optic element LCD via a gate TFT 1, which is selected by a gate line Gi. Then, the potential of the electro-optic element LCD is initialized to be the potential of an initialization line Dj via an initialization TFT 2, which is selected by an select line Ei.

Further, FIG. 20 shows an example of using organic EL, as an electro-optic element. In this example, each bit data is outputted to a source line Sj, and supplied to a capacitor C via a gate TFT 1, which is selected by a gate line Gi. The source-drain resistance of a driving TFT 3 is changed due to the potential of the capacitor C, and the current flowing from a power source line Pj to an optical element LED is set. Then, as with the arrangement of FIG. 19, the potential of the capacitor C is initialized to be the potential of the power source line Pj via an initialization TFT 2, which is selected by an select line Ei.

As described above, the application of the second driving method of the patent document 2 to an active matrix display device arises a problem that the initialization TFT 2, the select line Ej, and the initialization line Dj should be separately provided. In a liquid crystal display device having this arrangement, the aperture ratio is reduced, which causes a decrease of luminance efficiency particularly in a liquid crystal panel using a backlight. Further, in an organic EL display device having the foregoing arrangement, the luminance area is reduced, and therefore greater luminance is required for obtaining a target luminance for the entire panel, thus shortening the life of the elements.

SUMMARY OF THE INVENTION

The present invention is made in view of the foregoing conventional problems, and an object is to provide a driving device used for driving a wider range of electro-optic devices in which the target gradation can be set with respect to each stage output, and to provide a display device using the driving device, and to further provide a driving method thereof, and a weight determination method thereof.

In order to solve the foregoing problems, a driving device according to the present invention is a driving device for driving an electro-optic device including a plurality of electro-optic elements capable of R-gradation display (R being an integer not less than 2) according to gradation data; the driving device includes: a driving section for supplying A gradation data to the electro-optic elements in each frame period in a time divisional manner, and for selecting the electro-optic elements so as to satisfy $R^A>B$, where B is a number of weights of the A gradation data.

In a conventional driving device, while an electro-optic element is selected, the gradation data cannot be supplied to other electro-optic elements. Accordingly, the arrangements provides the relation of $B=R^A$. Further, when the weight of each instruction data is adjusted so as to provide a target value with respect to each stage of the output level in one frame period, the number of scanning lines of the electro-optic device is limited, which causes to limit the type of electro-optic device drivable in the arrangement.

On the other hand, in the driving device of the present invention, the weights of the instruction data are adjusted and set so as to satisfy the relation of $R^A>B$. Therefore, in comparison with the arrangement of setting the weight of each instruction data so as to realize the relation of $B=R^A$, this arrangement can increase the number of scanning lines capable of setting each gradation level to be a target value. As a result, the range of the electro-optic device in which the target gradation can be set with respect to each stage output can further be enlarged over one frame period.

It is preferable that the weight of the gradation data is determined according to a length of an output period, which is a period from a time at which a given gradation data is supplied to a time at which a next gradation data is supplied. In this case, the output in the frame period is controlled according to the stage of output of the electro-optic elements in each output period and the weight varying depending on the length of the output period. Therefore, the output in the frame period can be controlled with higher accuracy than the case of B-stage control of the electro optic elements.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 3 is a drawing showing a scanning condition adopted in Example 1 of the embodiment.

FIG. 5 is a drawing showing a scanning condition adopted in Example 2 of the embodiment.

FIG. 7 is a drawing showing another scanning condition adopted in Example 2 of the embodiment.

FIG. 8 is a drawing showing a further scanning condition adopted in Example 2 of the foregoing embodiment.

FIG. 9 is a drawing showing a scanning condition adopted in Example 3 of the embodiment.

FIG. 10 is a drawing showing another scanning condition adopted in Example 1 of the present invention.

FIG. 11 is a drawing showing a scanning condition adopted in Example 4 of the embodiment.

FIG. 12 is a drawing showing a scanning condition adopted in Example 5 of the embodiment.

FIG. 15 is a drawing showing another scanning condition adopted in Example 5 of the foregoing embodiment.

FIG. 22 is a drawing showing still another scanning condition adopted in Example 1 of the foregoing embodiment.

FIG. 24 is a drawing showing yet another scanning condition adopted in Example 2 of the foregoing embodiment.

FIG. 25 is a timing diagram showing a scanning method of time division gradation, which is realized by using the scanning condition shown in FIG. 24.

FIG. 26 is a drawing showing another scanning condition adopted in Example 4 of the foregoing embodiment.

FIG. 29 is a drawing showing another scanning condition adopted in Example 5 of the foregoing embodiment.

DESCRIPTION OF THE EMBODIMENTS

The following will explain one embodiment of the present invention with reference to FIGS. 1 through 15, and FIGS. 21 through 30.

Figure 21:
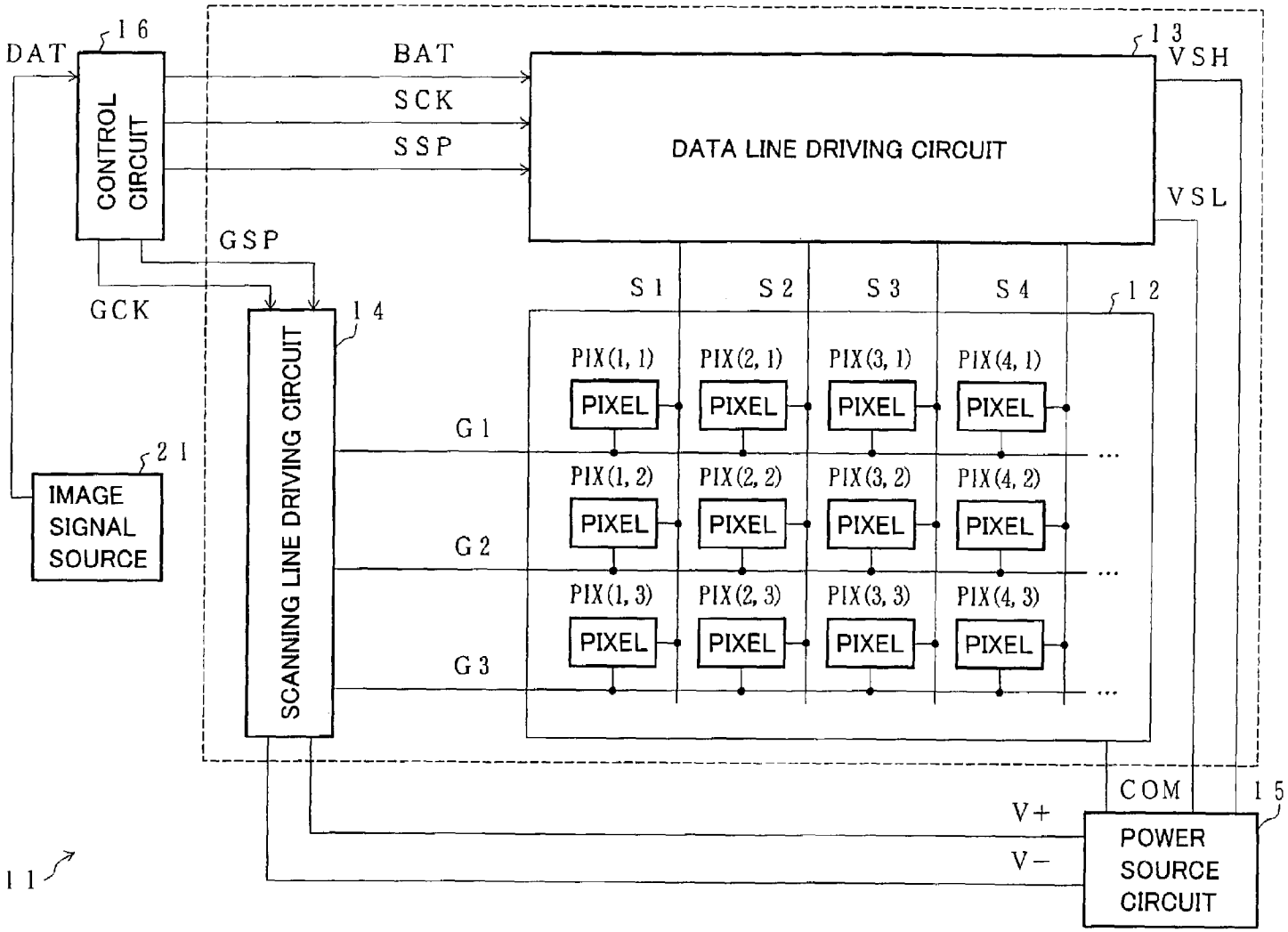
FIG. 21 is a block diagram showing an arrangement of a main part of a display device according to an embodiment of the present invention.

A display device 11 according to the present embodiment has a configuration including scanning lines whose number is too many to be scanned by the configuration disclosed in the foregoing patent document 2, and electro-optic elements with an arrangement which either cannot be realized by the configuration of patent document 2. However, even with the constitution cannot be realized by the configuration of the patent document 2, this display device 11 is arranged to realize high definition for each gradation level. As shown in FIG. 21, the display device 11 includes a pixel array 12 having pixels PIX (1, 1) through PIX (y, x) aligned in a matrix manner, a data line driving circuit 13 for driving data lines S1 through SX in the pixel array 12, a scanning line driving circuit 14 for driving scanning lines G1 through GY in the pixel array 12, a power source circuit 15 for supplying electric power to the driving circuits 13 and 14, a control circuit 16 for supplying an image signal that varies depending on an image signal DAT supplied from an image signal source 21 to the data line driving circuit 13, and also for supplying a control signal (such as start pulses SSP, GSP, clock signals SCK, GSK respectively supplied to these circuits) to the driving circuits 13 and 14. Note that, these driving circuits 13 and 14 correspond to a driving section, which is recited in the claims of the present invention; similarly, the pixel array 12 corresponds to an electro-optic device of the claims.

Before a minute explanation of driving methods of data lines and scanning lines by the driving circuits 13 and 14, the following will explain a schematic configuration and an operation manner of the entire display device 11. Further, for ease of explanation, only a member which needs to indicate its position will be given a number or a character for showing its position (e.g., j-th data line Sj), and the one needs not to indicate its position, or the one given a generic name, the character for showing the position will be omitted.

The pixel array 12 includes a plurality (X, in this case) of data lines S1 through SX, and a plurality (Y, in this case) of scanning lines G1 through GY which intersect with the data lines S1 through SX, respectively. Further, a pixel PIX (i, j) is provided for each combination of the data line Sj and the scanning line Gi, where j expresses an arbitrary integer in a range from 1 to X, and i expresses an arbitrary integer in a range from 1 to Y.

In the present embodiment, each pixel PIX (i, j) is provided between two adjacent data lines S (j−1) and Sj, and also between two adjacent scanning lines G (i−1) and Gi.

Figure 1:
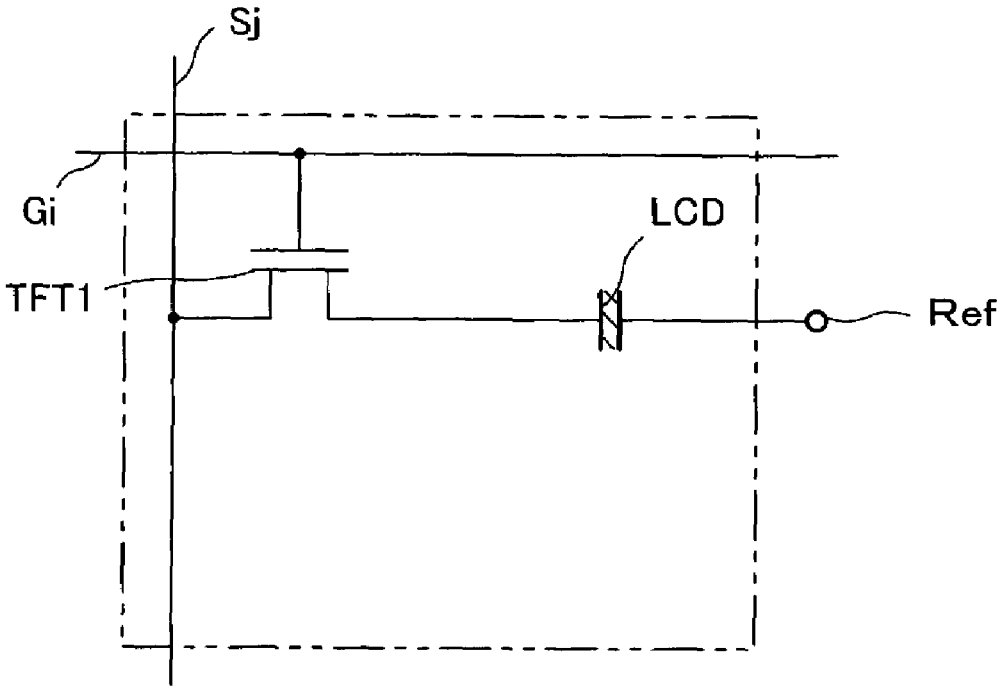
FIG. 1 is an equivalent circuit diagram showing an arrangement of a pixel circuit in the case of using liquid crystal other than ferroelectric liquid crystal, as an electro-optic element in a display device according to one embodiment of the present invention.
Figure 2:
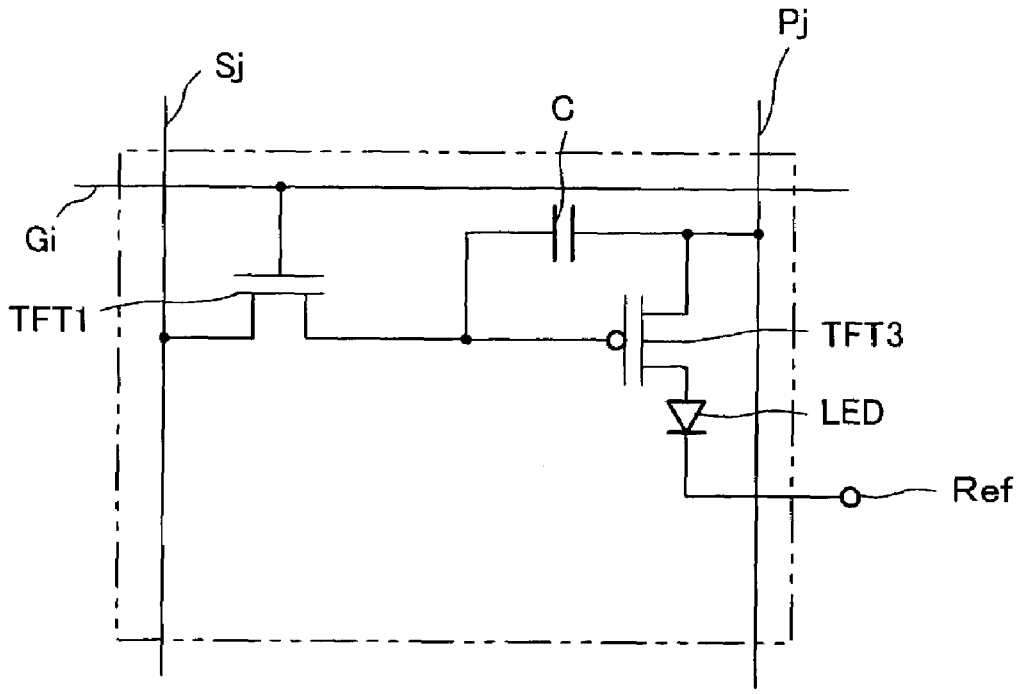
FIG. 2 is an equivalent circuit diagram showing an arrangement of a pixel circuit in the case of using an organic EL element, as an electro-optic element included in a display device according to one embodiment of the present invention.
Figure 19:
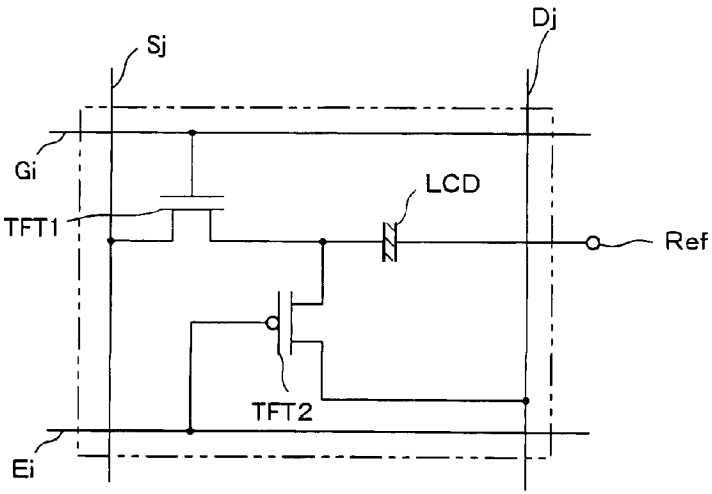
FIG. 19 CONVENTIONAL ART
FIG. 19 is an equivalent circuit diagram showing an arrangement of a pixel circuit in the case of using liquid crystal other than ferroelectric liquid crystal, in a conventional example.

The pixels PIX (i, j) has a configuration shown in FIG. 1 or that shown in FIG. 2, for example. Specifically, FIG. 1 is an equivalent circuit diagram of 1 pixel area in the display device 11 according to the present embodiment, and this example uses liquid crystal elements LCD, as the electro-optic element, which are made of liquid crystal other than ferroelectric liquid crystal, such as the TN liquid crystal. Note that, in contrast to the configuration of FIG. 19, the circuit of FIG. 1 does not include the initialization TFT 2, the select line Ei, and the initialization line Dj. In this configuration of FIG. 1, the sections having same functions as those of the configuration of FIG. 19 are given with the same reference symbols.

The display device 11 is an active matrix-type display device in which a liquid crystal element LCD is provided on an intersection of the data line Sj and the gate line Gi (the scanning line) in the pixel PIX (i, j) as the electro-optic element without a memory function. Further, the pixel PIX (i, j) includes a TFT 1 for providing memory function to the pixel PIX (i, j). Note that, Ref shown in FIG. 1 is a counter electrode. Further, since some Japanese Laid-Open Patent Applications, such as Tokukaihei 06-148616, minutely describe the configuration of FIG. 1, a minute explanation of this display device 11 is omitted here.

In the configuration of FIG. 1, each bit data is outputted to the data line Sj and then supplied to the electro-optic element LCD via a gate, i.e., the TFT 1, which is selected by the gate line Gi. More specifically, when the scanning line Gi is selected, the TFT 1 is electrically conducted in the pixel PIX (i, j), and a voltage, which has been supplied to the data line Sj, is supplied to the liquid crystal element LCD. Meanwhile, when the selecting period of the scanning line Gi is terminated, the liquid crystal element LCD keeps the voltage at the time when the TFT 1 is shut down, during the period in which the TFT 1 is shut down. Here, transmittance and reflectance of the liquid crystal varies depending on a voltage supplied to the liquid crystal element LCD. Thus, when the scanning line Gi is selected, and a voltage corresponding to the bit data to the pixel PIX (i, j) is supplied to the data line Sj, the display state of the pixel PIX (i, j) is changed according to the bit data. Note that, this bit data is data for indicating a gradation so as to instruct the pixel PIX (i, j) to carry out the gradation display.

Figure 20:
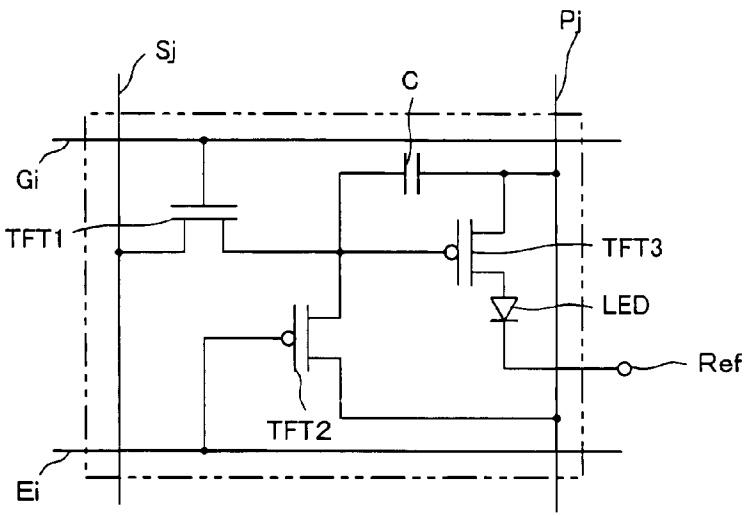
FIG. 20 CONVENTIONAL ART
FIG. 20 is an equivalent circuit diagram showing an arrangement of a pixel circuit in the case of using an organic EL element, in a conventional example.

Meanwhile, FIG. 2 is an example of using the organic EL elements LED as the electro-optic elements. In contrast to the configuration of FIG. 20, the circuit of FIG. 2 does not include the initialization TFT 2, the select line Ei, and the initialization line Dj. In this configuration of FIG. 2, the sections having same functions as those of the configuration of FIG. 20 are given the same reference symbols.

This display device 11 is an active matrix-type display device in which an organic EL element LED is provided on an intersection of the data line Sj and the gate line Gi in the pixel PIX (i, j) as the electro-optic element without a memory function. The pixel PIX (i, j) includes a TFT 1 for providing memory function to the pixel PIX (i, j). Note that, Ref shown in FIG. 2 is a counter electrode. Further, since some Japanese Laid-Open Patent Applications, such as Tokukaihei 11-176580, minutely describe the configuration of FIG. 2, and therefore, a minute explanation of this display device is omitted here. Similarly, as to the configurations of the TFT 1 and the TFT 3 used in the device as active elements, some Japanese Laid-Open Patent Applications, such as Tokukaihei 11-176580, minutely describe those configurations, and therefore a minute explanation thereof is also omitted here.

In the configuration of FIG. 2, each bit data is outputted to the source line Sj (the data line) and then supplied to the capacitor C via a gate TFT 1, which is selected by the gate line Gi. Then, the source-drain resistance of a driving TFT 3 is changed due to the potential of the capacitor C, and the current flowing from a power source line Pj to an electro-optic element LED is determined.

More specifically, when the scanning line Gi is selected, the TFT 1 is electrically conducted in the pixel PIX (i, j), and a voltage, which has been supplied to the data line Sj, is supplied to one end (an end on the gate side) of the capacitor C, which is provided between the gate and the drain of the driving TFT 3, via the TFT 1. Meanwhile, when the selecting period of the scanning line Gi is terminated, the capacitor C keeps the voltage at the time when the TFT 1 is shut down, during the period that the TFT 1 is shut down. Here, the drain of the TFT 3 is connected to the power source line Pj, and the source is connected to a reference voltage Ref via the organic EL element LED. Thus, the organic EL element LED is supplied with a current of which quantity varies depending on a voltage across the capacitor C. Further, luminance of the organic EL element LED varies depending on the quantity of the voltage flowing the organic EL element LED. Accordingly, when the scanning line Gi is selected, and a voltage corresponding to the bit data D to the pixel PIX (i, j) is supplied to the data line Sj, the display state of the pixel PIX (i, j) is changed according to the bit data D.

Note that, the foregoing examples adopt liquid crystal or organic EL elements LED; however, those configurations may also be adopted for other types of pixels in different arrangement, provided that the arrangement is capable of adjustment of brightness of the pixel PIX (i, j) according to the value of the signal applied to the data line Sj while a signal, showing the line is currently selected, is applied to the scanning line Gi. Thus, any arrangements with the foregoing condition may also be adopted regardless of whether or not a display of a self-luminous.

In the foregoing configuration, the scanning line driving circuit 14 shown in FIG. 21 outputs a signal, such as a voltage signal, to each of the scanning lines G1 through GY which indicates whether or not the line is currently selected (if the line is in the selection time). Further, the scanning line driving circuit 14 drives and selects the scanning line Gi to which the foregoing signal indicating the selection time is outputted to a different scanning line Gi according to a timing signal such as the clock signal GCK or the start pulse GSP supplied from the control circuit 16. With this operation, the scanning lines G1 through GY are sequentially selected in response to a predetermined timing.

Further, the data line driving circuit 13 extracts respective image data D, which are inputted to the pixels PIX (i, j) as the image signal DAT in the time divisional manner, by carrying out sampling of the image data D in response to a predetermined timing. Further, the data line driving circuit 13 outputs output signals, which respectively correspond to the image data D, to pixels PIX (i, 1) through (i, x) corresponding to the scanning line currently selected by the scanning line driving circuit 14, via the respective data lines S1 through SX. Note that, as it will be described later, each of the pixels PIX (i, j) is supplied with the bit data A times in one frame period, and the display gradation levels of the pixel PIX (i, j) in one frame period is determined by the combination of these bit data supplied to the pixels PIX (i, j) A times. Accordingly, the output signal is a signal which varies according to the bit data, in a narrow sense.

Meanwhile, each of the pixels PIX (i, 1) through PIX (i, X) determines its own brightness by adjusting transmittance or luminance at the lighting according to the respective output signals supplied to the corresponding data lines S1 through SX while the corresponding scanning line Gi is selected.

Here, the scanning line driving circuit 14 sequentially selects the scanning lines G1 through GY. Therefore, all pixels PIX (1, 1) through PIX (Y, X) of the pixel array 12 can be set to the brightness according to the image data D supplied to the respective pixels, so as to renew the image displayed in the pixel array 12.

Further, in the display device 11 according to the present invention, the scanning line driving circuit 14 selects the scanning lines G1 through GY so that each scanning line is selected A (A is an integer not less than 2) times in one frame period. In response thereto, the data line driving circuit 13 outputs the bit data (gradation data) to each of the pixels PIX (i, 1) through PIX (i, X) via the corresponding data lines S1 through SX, so that each pixel is supplied with the bit data A times in one frame period. Note that, the relation between the image data D and the bit data will be described after an explanation of a method for determining the weight of the data.

On this account, even though the pixel PIX (i, j) is only capable of R-gradation display, the number B of display gradations by the pixel PIX (i, j) can be greater than R over one frame period. Note that, the gradations displayed in one frame period can be found by adding all A bit data applied to the pixel PIX (i, j) in one frame period, each bit having a weight which varies depending on the length of period of the pixel PIX (i, j) during which the gradation indicated by the bit data is displayed (the length of period is the duration before the next bit data is applied).

A significant feature of the display device 11 of the present invention is that: the display device 11 of active-matrix type includes the electro-optic elements LCD and LED capable of R-gradation display (R is an integer not less than 2), and the display states of these electro-optic elements LCD and LED are respectively set as A (A is an integer not less than 2) times in one frame period by controlling the TFT 1, so as to realize B-gradation (B is an integer satisfying B>R) display; and each of the A bit data sequentially supplied to the data line Sj corresponds to a different bit, and the weights of A bit data are respectively set to satisfy $R^A>B$.

More specifically, in the conventional technique, when B-gradation display is realized by using electro-optic elements capable of R-gradation display; for example, when A bit data are sequentially aligned in order of weight, such as 1:2:4:8: . . . (i.e., $2^0:2^1:2^2:2^3$: . . . ), these bit data are all factorial numbers of R ($R^0:R^1:R^2:R^3$: . . . ) for the purpose of expressing a large number of gradations with as little number of bits as possible.

In this manner, in order to realize time division scanning which can provide an independent data transfer timing for each data line, the device has restriction with respect to one of the weight of bit R, the number of scanning lines, or the arrangement of electro-optic elements. Otherwise, the device is required to slightly vary the actual weight of bit. For example, the foregoing patent document 2 has limitation of the weight of bit R so that the configuration can be realized only in the case of satisfying R=4. Further, in the patent document 2, as described, the configuration requires limitation, which is given by, (the number of scanning line)×(the number of bits)/$\Sigma R^n$(summation of $R^n$($R$:weight ratio))=an integer.

Otherwise, the configuration requires the initialization scanning apart from the scanning for writing display data. Meanwhile, in the foregoing patent document 1, the actual weight of bit is slightly varied; specifically, the weight ratio is set to be 5:9:17:29, which is slightly varied from the original data weight ratio of 1:2:4:8.

In contrast, according to the display device 11 of the present invention, each weight of the bit data is determined so as to realize the relation of $R^A$>B. This configuration of the present invention is capable of determining a target gradation for the pixel PIX (i, j) over one frame period without strict limitation of the weight of bit, the number of scanning lines, or the arrangement of electro-optic elements, compared to the above case where the weight of bit data is determined so as to realize the relation of B=$R^A$. As a result, the range of the pixel array 12 in which the target gradation can be set with respect to the pixels (i, j) can further be enlarged over one frame period.

The following is an example of a method (a first method) adopted in the present embodiment for carrying out the scanning by adjusting the weight of each bit data so as to satisfy the relation of $R^A$>B. That is, the weight of each instruction data supplied during one frame period is adjusted so that one of pairs of instruction data adjacent to each other has a relation of G: G×R−n as their weight ratio, where G expresses an integer not less that 1, and n expresses an integer not less that 1 and not more than G×(R−1).

For example, when the bit data are sequentially aligned in order of weight, the weight ratio of the bit data is adjusted to be $R^0$:$R^1$: . . . $R^m$−n: . . . (m is an integer not less than 2, and n is an integer not less than 1), such as 1:2:4:7: . . . (i.e., $2^0$:$2^1$:$2^2$:$2^3$−1: . . . ); namely, this ratio is adjusted to change the conventional relation (the relation between factorial numbers of R) by adjusting the weight of bit at or after the third bit (for example, this operation is given by P×R>Q, where P expresses the weight ratio of the third bit, and Q expresses the weight ratio of the fourth bit).

The following will explain the foregoing method of determining the scanning method (a method of determining the weight of each bit data; a first weight determination method). Specifically, in the case of using the described A bit data, a time for selecting one scanning line is expressed as a selection time, and combined A selection times make up a unit time for control. Further, the first selection time in each unit time is expressed as a 0th occupied time, and the second selection time is expressed as a first occupied time. Namely, an A-th selection time is a (A−1)-th occupied time. The occupied time is used as a time slot for selecting the respective scanning lines. Further, the unit times for control are combined so as to constitute one frame period, the number of the unit times for control being equal to that of the scanning lines.

Secondly, as to each of the pixels, in contrast to the conventional technique in which the A bit data written to one given pixel are provided with sequential occupied times of 0→1→2 . . . (A−1) in order of lighter to heavier weight; however, in the present invention, the occupied times disorderly ascends and descends, such as 0→3→2→5→4, as shown in FIG. 3. Further, the occupied time is determined in the unit time so that the bit data can have the selection times accurately corresponding to the weight, and the occupied times are not overlapped with each other among the lower bit data (first through third lowest bits). For this purpose, the weight ratio of the A bit data is varied to be $R^0$:$R^1$: . . . $R^m$−n: . . . (m is an integer not less than 2, and n is an integer not less than 1) from the default values of $R^0$:$R^1$:$R^2$:$R^3$: . . . .

The following will minutely explain a method for determining the weight of the occupied time in the unit time. Firstly, the weight ratio of the A bit data is set to the default values of $R^0$:$R^1$:$R^2$:$R^3$: . . . .Secondly, the length of the display period of the bit which has the lightest weight is expressed as K, where K is a positive integer satisfying K<A. This is because the respective A bit data are provided with a same occupied time, when the relation of K=A is satisfied.

Further, the length of the display period of the first bit data is defined as, for example, $$f(1, K)\equiv(\text{the weight of the bit})\times K \quad (1)$$

and, the remainder from the division of the length of the display period f(1, K) by the number A of the bits is defined as follows;

$$ROT\,(A, f(1, K))\equiv\text{the remainder of }(f(1, K)/A) \quad (2).$$

Further, the first bit data, which is firstly displayed, is provided with the 0th occupied time (a reference occupied time), and the length of the display period is expressed as follows.

$$ROT\,(A, f(1, K))=ROT\,(A, K)=K\neq 0 \quad (3)$$

Namely, because of K<A, the first bit data finishes its display in the K-th occupied time, which differs from the 0th occupied time thus decided as the occupied time of the first bit data. Therefore, the occupied time of the second bit data which is secondly displayed is set to be the K-th occupied time.

Next, it is checked whether or not the following equations are satisfied by using the length f(2, K) of the display period of the second bit data, $$ROT\,(A, f(1, K)+f(2, K))\neq 0 \quad (4)$$

$$ROT\,(A, f(1, K)+f(2, K))\neq K \quad (5)$$

and, if the equations are not satisfied, the weight of the second bit is varied (e.g., reduced by 1), so as to satisfy the foregoing equations.

Next, it is assumed that the occupied time of the third bit, which is thirdly displayed, is expressed as P, and it is checked whether or not the following equations are satisfied by using the length f(3, K) of the display period of the third bit data.

$$ROT\,(A, f(1, K)+f(2, K)+f(3, K))\neq 0 \quad (6)$$

$$ROT\,(A, f(1, K)+f(2, K)+f(3, K))\neq K \quad (7)$$

$$ROT\,(A, f(1, K)+f(2, K)+f(3, K))\neq P \quad (8)$$

If the equations are not satisfied, the weight of the third bit, or a bit lighter in weight than the third bit is varied (reduced by 1), so as to satisfy the foregoing equations 4 through 8.

In this manner, this operation is repeated down to the A−1 bit data, and the display period f(A, K) of the last A bit data is adjusted to have the foregoing reference occupied time of 0, which is given by the following equation.

$$ROT\,(A, f(1, K)+f(2, K)+\ldots+f(A, K))=0 \quad (9)$$

Then, by referring to the order and the weight of the bit data thus obtained, the weight of each bit and the timing for selecting the scanning line G1 are determined. The timing for selecting the scanning line Gi is determined by setting the length of the first bit to satisfy K+G×A (G is an integer not less than 0). The timing for selecting the scanning line Gi+1 is determined so that the timing for selecting the scanning line Gi+1 is put behind (or ahead) the timing for selecting the scanning line Gi by A selection times. This determination operation is repeated down to the last scanning line, in the same manner.

Thus, the weight of the bit data and the scanning timing of the scanning line are determined. Consequently, by driving the pixel array 12 with the driving circuits 13 and 14 shown in FIG. 21 in accordance with the weight and the scanning timing thus determined, there realizes a display device 11 driven by the first scanning method, which is one of the methods for carrying out the present invention.

Here, when the weight is set in the foregoing manner; as described, the displayable number B of the gradation of the display device 11 is smaller than $R^A$ (for example, B=48 gradations despite of $R^A$=64). Meanwhile, external input data (for example, the image data D shown in FIG. 21) is in the form of binary numerals in many cases. In such cases, a ROM (Read Only Memory) having a LUT (Look-up Table) for converting the image data D into the B-gradation display is provided in the control circuit 16, and the combination of the bit data supplied to the pixel PIX (i, j) is determined by referring to the LUT based on the input image data D, for example. Further, each time the pixel PIX (i, j) is selected, the control circuit 16 selects bit data BAT, which is the data supposed to be supplied to the pixel PIX (i, j), among the foregoing combinations of the bit data, and supplies the bit data BAT to the pixel PIX (i, j).

Note that, though the foregoing example is provided with a LUT, the combination of the bit data may be determined by, for example, calculation, provided that it is possible to determine how the image data D corresponds to the combination of the bit data to be supplied to the pixel PIX (i, j) when the image data D is supplied.

In the foregoing operation in which the display device 11 determines the combination of the bit data to be supplied to the pixel PIX (i, j) based on the input image data D included in the image signal DAT, any devices can be adopted as the external device (for example, the image signal source 21) for supplying the image signal DAT can supply the identical image signal DAT irrespective of whether the external device is the display device 11 according to the present embodiment. Accordingly, versatility of the display device 11 can be improved.

Further, as described above, the weight of the bit data is set to, for example, 1:2:4:7, so as to provide a plurality of combinations of the bit data corresponding to the same display gradation level. Although a plurality of combinations of the bit data are provided corresponding to the same display gradation level, when B displayable gradation levels of the display device 11 are aligned in ascending order (i.e., order of smaller to greater), the gradation levels in the adjacent unit time have the same selection times even when compared in terms of the selection time unit. For example, in the case of the above numeric value, according to the foregoing patent document 1, when it is intended to realize 1:2:4:8, it ends as 5:9:17:29 in terms of the selection time unit. As a result, the difference between the gradation levels 5 and 9 adjacent to each other is equal to 4, but the next gradation levels 9 and 14 adjacent to each other has the difference of 5. On the other hand, according to the display device 11 of the present embodiment, the difference between any gradation levels adjacent to each other is always equal to the gradation level corresponding to 1 selection time for 15 gradation levels 0 through 14.

Accordingly, in the display device according to the present embodiment, each gradation level has a linear characteristic with respect to the order of the output gradation levels which can be outputted. Further, as it is minutely described later, as the number of bits increases, a decrease of the ratio of gradation numbers is less, compared to the case of $R^A$=B. Thus, the means for determining the combination of the bit data based on the image data D can be realized by a relatively simple circuit or calculation.

Further, as described, the transmission of the image signal DAT is carried out, for example, by collecting the image data D separately for each pixel PIX (i, j), and sequentially transmitting the collected data. Accordingly, in order to carry out time division gradation display as with the present embodiment, the data indicating the image data or the bit data needs to be held during the interval between the time when the bit data corresponding to the image data is supplied to the display device 11, and the time when the bit data is supplied to the pixel PIX (i, j). Therefore, the display device 11 requires a frame memory.

On this account, even when the display device 11 is provided with the means for determining the combination of the bit data based on the image data D such as the ROM, it is possible to realize the display device 11 without significantly enlarging its circuit scale, since the means has a much smaller circuit scale than the foregoing frame memory.

As described, the first weight determination method of the present embodiment includes the steps of: (a) carrying out initialization so that a given bit data has an weight of R times of the weight of the immediately preceding bit data, when the bit data are aligned in order of smaller to greater weight; and (b) providing a predetermined selection time as the selection time (occupied time) for starting the output period of the first bit data in the foregoing order. Further, in the first weight determination method of the present embodiment, the following operation is repeated until all the bit data are provided with the selection times. The operation includes the steps of (c) determining the length of output period corresponding to the bit data according to the weight of the bit data, and providing the selection time for starting the output period of the next bit data as the selection time at the time when the output period before is terminated; (d) judging whether or not the provided selection time of the next bit data is the same as the selection time which has been provided before; (e) and when it is judged that the selection time is the same as the one provided before, adjusting (1) the selection time for the next bit data, which is obtained by reducing the weight of the bit data whose length of the output period has been determined in or before the step (c), and (2) the selection times which have ever been provided, so that the selection times are not overlapped with each other.

In the foregoing arrangement, when it is judged that the selection time to be provided to the next bit data is the same as the selection time which has been provided before, the selection times are adjusted for the next bit data, which is obtained by reducing the weight of the bit data whose length of the output period has been determined in or before the step (c) and the selection times which have ever been provided (for example, in case of determining the length in order of lighter to heavier weight, bit data lighter in the weight than the bit data subjected to the next weight determination), so that the selection times are not overlapped with each other.

As a result, regardless of the number of the scanning lines, the display gradation number B over the one frame period can be set to be smaller than $R^A$ to an extent, that the timings at which the respective bit data corresponding to different scanning lines are sent to the data lines are not overlapped each other (selection time) for being supplied to the data line; and also, when the gradation levels are aligned in order of lower to higher, the difference between the gradation levels adjacent to each other can be always a fixed value.

Further, in the second weight determination method of the present embodiment, after setting the occupied time of the second bit data in the foregoing manner, it is determined whether or not the equations 4 and 5 are satisfied. If the equations 4 and 5 are not satisfied, the third bit data or later bit data is allotted instead of the second bit data, so as to satisfy the equations 4 and 5.

Next, it is assumed that the occupied time of the third bit, which is displayed next, is expressed as P, and it is checked whether or not the aforementioned equations 6 through 8 are satisfied by using the length f(3, K) of the display period of the third bit data. If the equations are not satisfied, the fourth bit data or later bit data (unused bit data) is allotted as the third bit data, so as to satisfy the foregoing equations 6 through 8. Note that, if there is a difficulty to satisfy the foregoing equations 6 through 8, the weight of the second bit data or later bit data is varied (reduced by 1), so as to satisfy the foregoing equations 6 through 8.

In this manner, this operation is repeated down to the last A−1 bit data, and the display period f(A, K) of the last A bit data is determined by referring to the aforementioned equation 9. Also, the weight of each bit and the timing for selecting the scanning line G1 is determined by referring to the order and the weight of the bit data thus obtained. The timing for selecting the scanning line G1 is determined by setting the length of the first bit to satisfy K+G×A (G is an integer not less than 0). The timing for selecting the scanning line Gi+1 is determined so that the timing for selecting the scanning line Gi+1 is put behind (or ahead) the timing for selecting the scanning line Gi by A selection times. This determination operation is repeated down to the last scanning line, in the same manner.

As described, in the second weight determination method of the present embodiment, before reducing the weight of the bit data lighter in the weight than the current bit data, one of the instruction data which have not been provided with the selection time is provided as the next instruction data, which is to be provided with the selection time next. With this provision, the selection times are adjusted so that the all bit data, including the bit data which have been provided with the selection times and the bit data which is to be provided with the selection time next, are not overlapped with each other. In this arrangement, the adjustment of the weight is carried out by changing the order of the instruction data for providing the selection times before reducing the weight of the data, so that the overlapping of the respective selection times is avoided. Consequently, it is possible to increase number of outputs in a frame period, compared to the case where the order of providing the selection time is fixed.

Further, the weight of the bit data and the scanning timing of the scanning line can be determined also by the foregoing second weight determination method of the present embodiment. Therefore, with the foregoing manner, the weight of the bit data and the scanning timing of the scanning line are determined. Consequently, by driving the pixel array 12 with the driving circuits 13 and 14 shown in FIG. 21 by using the weight and the scanning timing thus determined, there realizes a display device 11 driven by the first scanning method (the scanning method in which the weight of the A bit is not set to be 0), which is one of the methods for carrying out the present invention.

Further, the present embodiment teaches another example (the second scanning method) of scanning method in which the weight of each bit data is adjusted to satisfy $R^A>B$. This scanning method of the present embodiment is a method of providing a blanking period, which is given by, (number of scanning lines×number of bits)−(summation of the weight of all bits), by setting the weight of the last A bit to be 0. In this arrangement, it is not necessary to limit the number of scanning lines according to the condition, given by, number of scanning lines=(summation of the weight of all bits)/number of bits.

Thus, the selectable number of the scanning line can be significantly increased. Especially, according to the method of setting the weight of the last A bit to be 0 (second weight determination method of the present embodiment), it is not necessary to satisfy the equation 9 in the first weight determination method of the present embodiment. Thus, the selectable number of the scanning line can remarkably be increased.

EXAMPLE 1

The following will explain an example of the occupied time used for the first scanning method (the scanning method in which the weight of the A bit is not set to be 0) of the present embodiment, together with a weight determination method (a first weight determination method). This example uses five bit data. In this case, one unit time includes five selection times. Also, it is assumed that the first selection time is a 0th occupied time, the second selection time is a first occupied time, . . . , the last selection time is fourth occupied time. Further, the display period K of the least significant bit is assumed to be 2, which satisfies 2<A=5. FIG. 3 shows the result of the first method of the present invention according to the foregoing assumption. The following will explain the process of figuring out the condition shown in FIG. 3.

Firstly, it is assumed that the occupied time of the first bit data, which starts the display, is 0. Also, since the length of display period f(1, K) of the least significant bit data is 2 as thus assumed, the second bit data is provided with the second occupied time. Then, the length f(2, K) of the display period of the second bit data is determined according to: 2×(1+1)=4, and the occupied time of the third bit data is determined according to the foregoing equations 4 and 5.

$$ROT(A, f(1, K) + f(2, K)) = ROT(5, 2+4) = ROT(5, 6) = 1 \quad (10)$$

Since this occupied time defers from the foregoing 0th occupied time or the second occupied time, the operation goes to the process for the next bit data.

The length f(3, K) of the display period of the third bit data is assumed according to: 2×(1+1+2)=8, and the occupied time of the fourth bit data is determined according to the foregoing equations 6 through 8.

$$ROT\left(A, \sum f(1 \sim 3, K)\right) = ROT(5, 2+4+8) \quad (11)$$

-continued $$= ROT(5, 14) = 4$$

$$\Sigma f(1\sim3, K) = f(1, K) + f(2, K) + f(3, K) \quad (12)$$

Since this occupied time also defers from the foregoing 0th, the first, or the second occupied times, the operation goes to the process for the next bit data.

The length f(4, K) of the display period of the fourth bit data is assumed according to: 2×(1+1+2+4)=16, and the occupied time of the fifth bit data is determined according to the foregoing equations 6 through 8.

$$ROT\left(A, \sum f(1 \sim 4, K)\right) = ROT(5, 2+4+8+16) \quad (13)$$

$$= ROT(5, 30) = 0$$

Since this 0th occupied time already exists as the initial value of the first bit data, the display period f is reduced by 2 (corresponding to 1 gradation), i.e., f(4, K)=14. Then, by using this value, again the foregoing equation 13 is referred.

$$ROT\ (A, \Sigma f(1\sim4, K)) = ROT\ (5,28) = 3 \quad (14)$$

Since this occupied time does not exist according to the previous checking, i.e., this occupied time has not been provided, the operation is completed.

Note that, since the occupied times are provided to the respective five bit data, it is shown that the occupied times 0 through 4 are all used at last. Here, when the display period of the fifth bit data is terminated, it is preferable that the sequence again starts from the 0th occupancy time, which is provided to the first bit. Accordingly, the length f(5, K) of the display period of the fifth bit is adjusted to satisfy the foregoing equation 9 as follows.

$$ROT\ (A, \Sigma f(1\sim5, K)) = ROT\ (5, 28 + f(5, K)) = 0 \quad (15)$$

Since the equation is satisfied on the condition that f(5, K)=2+5××G, it is determined that: f(5, K)=22. This satisfies the condition for starting sequence again from the first bit (going back again to the 0th occupied time), and here all conditions are prepared.

Figure 4:
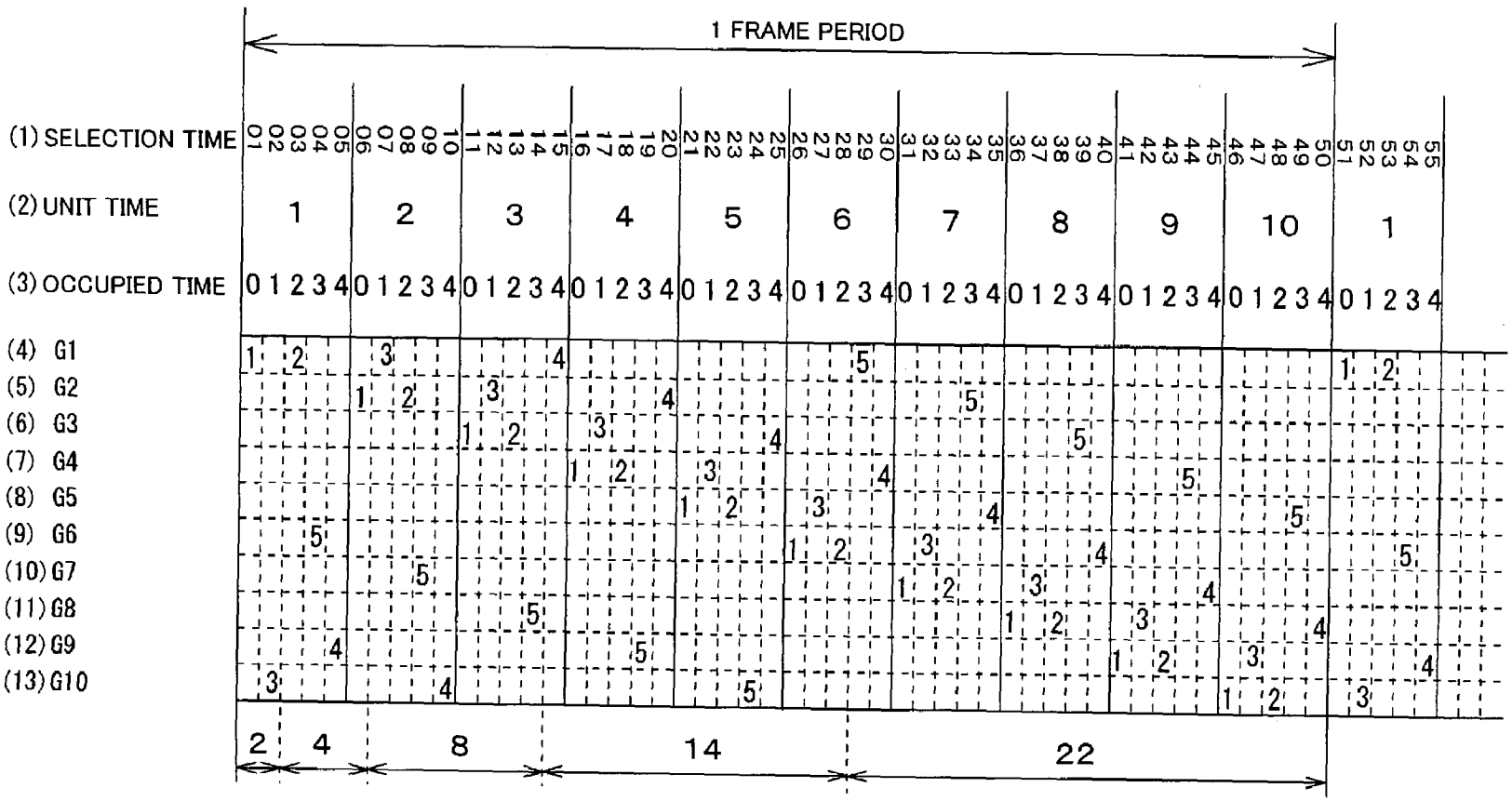
FIG. 4 is a timing diagram showing a scanning method of time division gradation, which is realized by using the scanning condition shown in FIG. 3.

FIG. 3 shows the condition thus figured out with the foregoing operation. As shown in the figure, the display period of each bit data is 2:4:8:14:22, and therefore, the summation of the display period of five bits is 2+4+8+14+22=50. By dividing this value by the number of bits=5, obtained is 10 as the number of scanning lines; thus, the conditions correspond to 10 scanning lines. FIG. 4 shows the timing for selecting the scanning lines G1 through G10 by using the 50 selection times shown in (1) as a time axis. In the figure, as (2) shows, 1 unit time includes selection times corresponding to 5 bits, and as (3) shows, 0th through 4th occupied times are provided as with the foregoing explanation.

As (4) in the figure shows, the timing for selecting the scanning line G1 is set as follows: the first bit data (weight=1, display period=2 selection times) which has been sent to the data line is displayed in the first selection time (the 0th occupied time in the first unit time); the second bit data (weight=2, display period=4 selection times) which has been sent to the data line is displayed from the third selection time (the second occupied time in the first unit time) which is 2 selection times later than the selection time that the first bit data is displayed; the third bit data (weight=4, display period=8 selection times) which has been sent to the data line is displayed from the seventh selection time (the first occupied time in the second unit time) which is 4 selection times later than the selection time that the second bit data is displayed; the fourth bit data (weight=7, display period=14 selection times) which has been sent to the data line is displayed from the fifteenth selection time (the fourth occupied time in the third unit time) which is 8 selection times later than the selection time that the third bit data is displayed; and the fifth bit data (weight=11, display period=22 selection times) which has been sent to the data line is displayed from the twenty-ninth selection time (the third occupied time in the sixth unit time) which is 14 selection times later than the selection time that the fourth bit data is displayed. Further, the first bit data is again displayed in the fifty-first selection time (the 0th occupied time in the first unit time of the next frame) which is 22 selection times later than the selection time that the fifth bit data is displayed, and then, one frame period is completed.

The timings for selecting the rest of the scanning lines G2 through G10 shown in (5) through (13) are prepared so that 1 unit time is put behind with respect to the respective timings for selecting the immediately preceding scanning lines.

Note that, in the foregoing conditions, the weight of the first bit is decided as 2, and therefore the weight ratio is 2:4:8:14:22; however, the number of bits=5 may be added to the weight of the first bit, since the ratio figured out by adding 5, which will be 7:14:28:49:77, brings the same result. Further, though it is not shown in the figure, the foregoing conditions can be satisfied when the five bits have the weight ratio of 1:2:4:7:11 (in this case, the respective positions of the five bits are the 0th, the first, the third, the second, the fourth, in terms of their occupied times). Further, the foregoing condition can also be satisfied when the five bits have the weight ratio of 3:6:12:21:33 (in this case, the respective positions of the five bits are the 0th, the third, the fourth, the first, the second, in terms of their occupied times). The foregoing arrangement of adding 5 to the weight of the first bit may also be adopted in these two cases, and therefore many of the scanning lines can be used for these arrangements.

Further, FIG. 22 shows another example of the occupied time decided by the first weight determination method of the present embodiment, to be used for driving by the first scanning method. In the example of FIG. 22, the electro-optic elements are capable of 4-gradation display (R=4). Also, two bit data (A=2) are supplied in one frame. In this case, 1 unit time includes 2 selection times, and the first occupied time is 0th occupied time and the next one is 1st occupied time.

Also in this example, the 0th occupied time is provided to the first bit data, which starts the display. As it is assumed that the display period f(1, K) of the least significant bit is 3, the second bit data is provided with the first occupied time. Then, it is assumed that: f(2, K)=9, in order to satisfy the equation of:

$$ROT\ (A, \Sigma f(1\sim2, K)) = ROT\ (2, 3 + f(2, K)) = 0.$$

Figure 23:
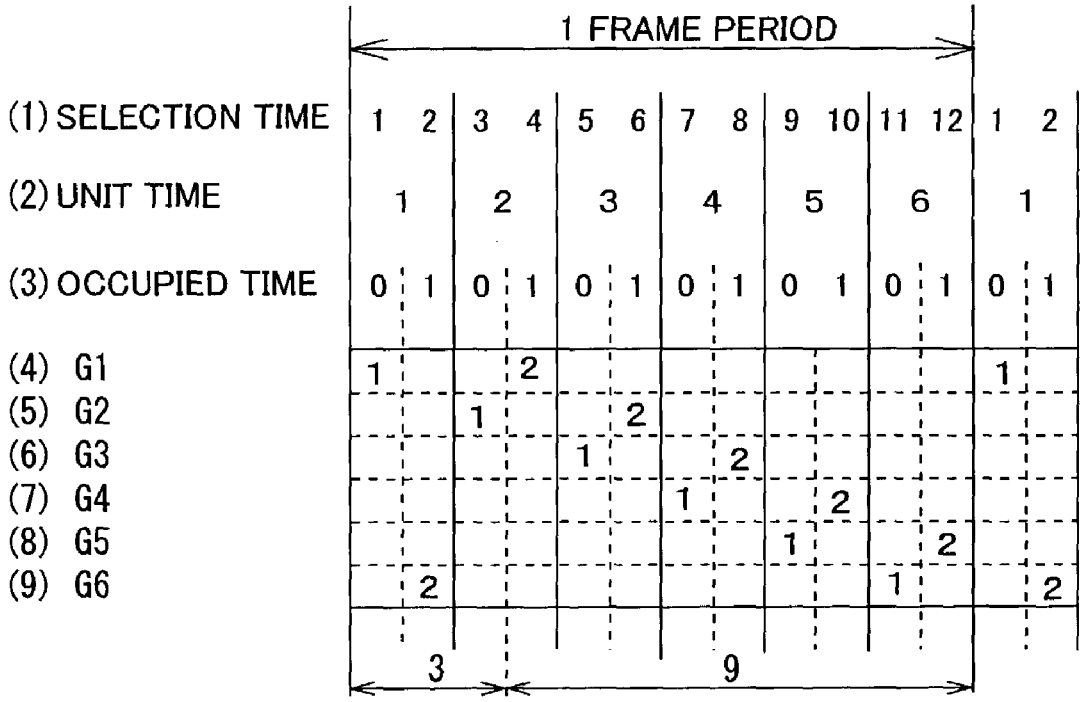
FIG. 23 is a timing diagram showing a scanning method of time division gradation, which is realized by using the scanning condition shown in FIG. 22.

According to FIG. 22, Σf(1~2, K)=12, and therefore the number of scanning lines is 12/2=6. FIG. 23 shows the timing chart of this example.

This case also realizes the relation of $R^A$>B. Therefore, in contrast to the case where the weight of each instruction data is set so as to realize the relation of B=$R^A$, this case can increase the number of scanning lines capable of setting each gradation level to be a target value. As a result, the range of the desirable value with respect to the gradation of the pixel array 12 can further be enlarged over one frame period. Further, FIG. 10 shows a still another example of a condition of weight of bit in case of satisfying R=2 and A=8.

As it has been explained, by determining the weight of data by using the first weight determination method of the present embodiment, which determines, for example, the weight ratio of 1:2:4:7:11 with respect to the first through fifth bit data, and also carrying out driving in accordance with the first scanning method of the present embodiment, it is possible to realize time division gradation display providing accurate gradation display (for example, 26-gradation), even in an arrangement which does not include an initialization TFT.

EXAMPLE 2

The following will explain in detail an example of the occupied time in the second scanning method (the scanning method in which the weight of the A bit is set to be 0) of the present embodiment, together with a weight determination method (a first weight determination method). In this example, the electro-optic element is capable of 4 gradation display (R=4), and three bit data are used (A=3). In this case, one unit time includes three selection times. Also, it is assumed that the first occupied time is a 0th occupied time, the next occupied time is a first occupied time, and the yet next occupied time is a second occupied time. Also in this case, it is assumed that the first bit data, which starts the display, is provided with the 0th occupied time. The length f(1, K) of display period of the least significant bit data is assumed to be 4, and therefore the second bit data is provided with the first occupied time. Then, the length f (2, K) of the display period of the second bit data is according to: 4×4=16, and then the following calculation is obtained.

$$ROT\ (A,\ \Sigma f(1\sim 2,\ K))=ROT\ (3,\ 4+16)=2$$

Since this occupied time defers from the 0th, and the first occupied time, the occupied time of the third bit is determined.

Since the weight of the third bit is 0, its length of the display period does not need to be taken into account. Then, all of the occupied times and the weights of the bits are determined, which are shown in FIG. 24.

Further, assuming that the number of scanning lines is 10, as with the example shown in FIG. 25, the following calculation is obtained.

(number of scanning lines×number of bits)−(summation of the weight of all bits)=10×3−(4+16+0) =10

By including this result of calculation as a blanking period in which the weight of bit is set to be 0, the scanning timing is created.

Next, the following will explain an example of the occupied time in the first scanning method of the present embodiment, together with a weight determination method (a first weight determination method). This example uses five bit data. Among these, four bits data are used for display, and the remaining one bit is used as an initialization bit (a bit with the weight of 0). Since this case uses five bit data including the initialization bit, i.e., the number of bits is: A=5, one unit time includes five selection times. Also, it is assumed that the first selection time is a 0th occupied time, the second one is a first occupied time, . . . , the last one is a fourth occupied time. Further, the display period K of the least significant bit is assumed as 3, which satisfies 3<A=5. FIG. 5 shows the condition of the first method of the present invention according to the foregoing assumption. The following will explain the process of figuring out the condition shown in FIG. 5.

Firstly, it is assumed that the occupied time of the first bit data, which starts the display, is 0. Also, since the length of display period f(1, K) of the least significant bit data is 3, the second bit data is provided with the third occupied time. Then, the length f(2, K) of the display period of the second bit data is determined according to: 3×(+1)=6, and the occupied time of the third bit data is determined according to the foregoing equations 4 and 5.

$$\begin{aligned} ROT(A,\ f(1,\ K)+f(2,\ K)) &= ROT(5,\ 3+6) \\ &= ROT(5,\ 9)=4 \end{aligned} \tag{16}$$

Since this occupied time defers from the foregoing 0th occupied time or the third occupied time, the operation goes to the process for the next bit data.

The length f(3, K) of the display period of the third bit data is determined according to: 3×(1+1+2)=12, and the occupied time of the fourth bit data is determined according to the foregoing equations 6 through 8.

$$\begin{aligned} ROT\left(A,\ \sum f(1\sim 3,\ K)\right) &= ROT(5,\ 3+6+12) \\ &= ROT(5,\ 21)=1 \end{aligned} \tag{17}$$

Since this occupied time also defers from the 0th, 3rd, and 4th occupied times, the operation goes to the process for the next bit data.

The length f(4, K) of the display period of the fourth bit data is determined according to: 3×(1+1+2+4)=24, and the occupied time of the fifth bit data is determined according to the foregoing equation 13.

$$\begin{aligned} ROT\left(A,\ \sum f(1\sim 4,\ K)\right) &= ROT(5,\ 3+6+12+24) \\ &= ROT(5,\ 45)=0 \end{aligned} \tag{18}$$

Since this 0th occupied time already exists as the initial value of the first bit data, the display period is reduced by 3 (corresponding to 1 gradation), i.e., f(4, K)=21. Then, by using this value, again the foregoing equation 13 is referred.

$$ROT\ (A,\ \Sigma f(1\sim 4,\ K))=ROT\ (5,\ 42)=2 \tag{19}$$

Since this occupied time does not exist, i.e., this occupied time has not been provided, the operation is completed.

Note that, as it is shown in the foregoing operation, since the occupied times are provided to the respective five bit data, it is shown that the occupied times 0 through 4 are all used at last. Here, since the last fifth bit is the initialization bit, the time when the display of the fifth bit data is terminated does not need to be taken into account. However, it should be noted that, the summation (3+6+12+21=42) of the display periods of the first through fourth bit data is required to be smaller than (the number of bits 5)×(the number of scanning lines). Accordingly, the number of scanning lines should be not less than 9. Then, all factors of the condition are determined, and the condition shown in FIG. 5 is prepared. As shown in the figure, the display period of each bit data is 3:6:12:21:0 in this case, and the following relations are obtained.

$$(3+6+12+21)/5=8.4$$

$$8.4<9$$

The relations indicate that the required number of the scanning lines should be not less than 9. Then, by providing 10 scanning lines, selecting timings of the scanning lines G1 through G10 are created as shown in FIG. 6, according to the condition of FIG. 5.

As shown in (1) of the figure, one frame period includes 50 selection times, which is obtained by:

$$(\text{number of bits})\times(\text{number of scanning lines})=50.$$

Figure 6:
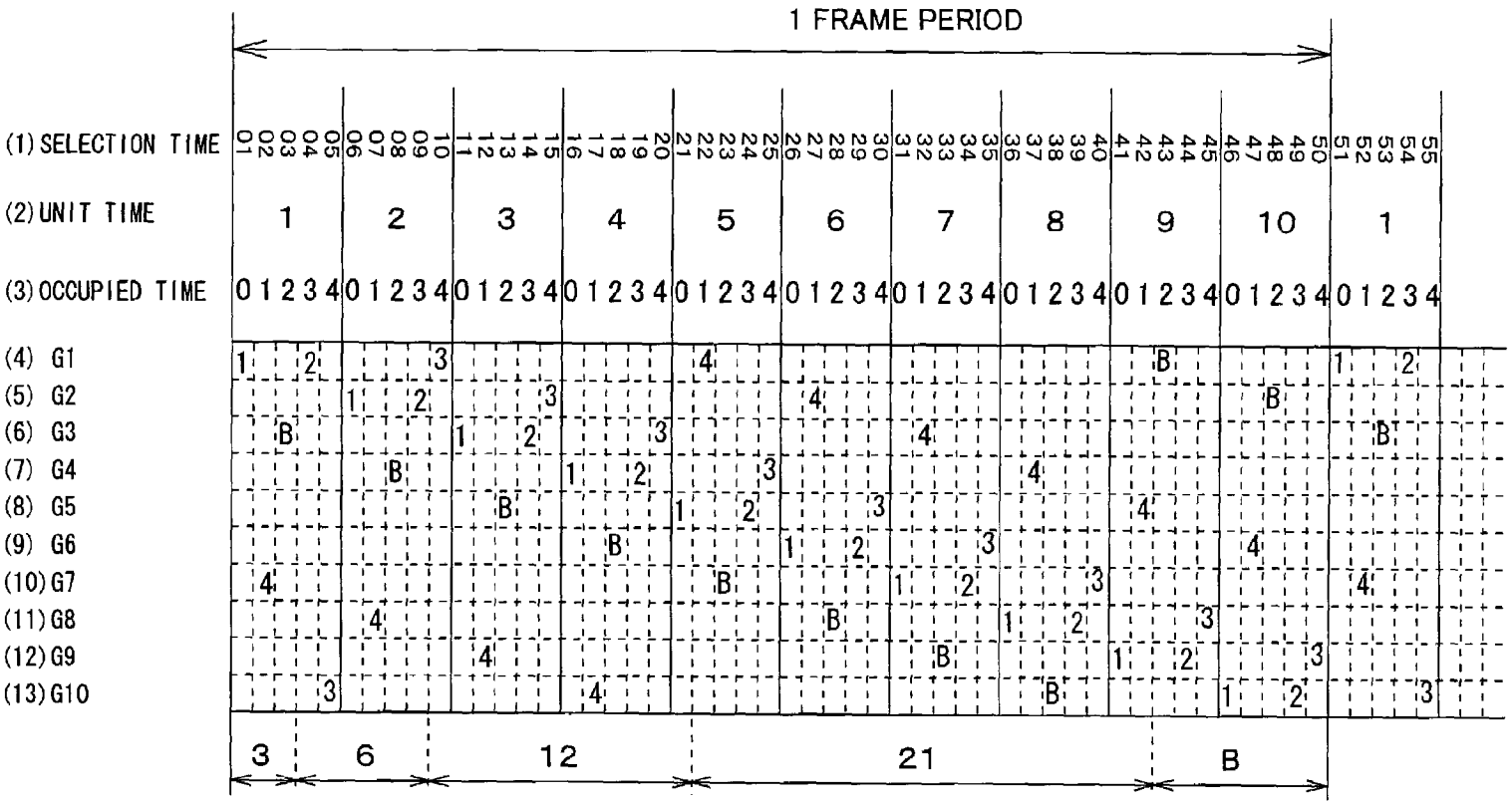
FIG. 6 is a timing diagram showing a scanning method of time division gradation, which is realized by using the scanning condition shown in FIG. 5.

The selection times are used as a time axis in FIG. 6. Further, as (2) of the figure shows, 1 unit time includes 5 selection times, which is for the number of bits, and as (3) shows, 0th through 4th occupied times are provided.

As (4) in the figure shows, the timing for selecting the scanning line G1 is determined as follows: the first bit data (weight=1, display period=3 selection times) is displayed in the first selection time (the 0th occupied time in the first unit time); the second bit data (weight=2, display period=6 selection times) is displayed from the fourth selection time (the third occupied time in the first unit time) which is 3 selection times later than the selection time that the first bit data is displayed; the third bit data (weight=4, display period=12 selection times) is displayed from the tenth selection time (the fourth occupied time in the second unit time) which is 6 selection times later than the selection time that the second bit data is displayed; the fourth bit data (weight=7, display period=21 selection times) is displayed from the twenty-second selection time (the first occupied time in the fifth unit time) which is 12 selection times later than the selection time that the third bit data is displayed; and the initialization bit (weight=0, display period=an arbitrary number) is displayed in the forty-third selection time (the second occupied time in the ninth unit time) which is 21 selection times later than the selection time that the fourth bit data is displayed. Then, one frame period is completed.

The selecting timings of the rest of the scanning lines G2 through G10 shown in (5) through (13) are decided so that the respective timings are 1 unit time behind the timing for selecting immediately preceding scanning line. As described, the first weight determination method of the present embodiment is adopted for determining the weight of data used in the second scanning method. On this account, by determining the weight of data, for example, to be 1:2:4:7:0, with respect to the first to fifth bit data, it is possible to realize time division gradation display providing accurate gradation display (for example, 15 gradations), even in an arrangement which does not include an initialization TFT. Further, since the display period of the first bit data is 1 selection time, the required number of scanning lines is only not less than 3; therefore, it is not necessary to provide 10 scanning lines.

The case of determining the weight of data for the first scanning method by using the first weight determination method of the present embodiment has a limitation of using an electro-optic elements capable of R-gradation display, and determining the weight of A bit data to be G: G×R−nG, where G is an integer not less than 1 and n is an integer not less than 1 and not more than G×(R−1), so as to obtain the bit weight ratio in which the occupied times of the respective bits are not overlapped with each other, and using the foregoing equation 9 so that the occupied time goes back again to 0th for starting the first bit at the time that the last bit data is finished; in contrast, determining the second scanning method by using the first weight determination method of the present embodiment enables free selection of the number of the scanning lines, since the last initialization bit has an arbitrary display period, and therefore the foregoing limitation is not necessary.

Here, FIG. 7 shows the condition, which is found out for carrying out gradation display by using 6 bits (the number of bits A=7 including the initialization bit) and 240 scanning lines. The weight of each bit is set to be 1:2:3:6:13:26:0. This weight ratio condition can be satisfied unless the length of display period of the least significant bit is a multiple number of 7 (the number of selection times in one unit time).

Further, FIG. 8 shows the condition, which is found out for carrying out gradation display by using 8 bits (the number of bits A=9 including the initialization bit) and 480 scanning lines. The weight of each bit is set to be 1:2:4:8:16:31:60:123:0. This weight ratio condition can be satisfied unless the length of display period of the least significant bit is a multiple number of 3.

EXAMPLE 3

The following will explain an example using the second weight determination method as a weight determination method for the first scanning method of the present embodiment. This example uses six bit data. In this case, one unit time includes six selection times. Also, it is assumed that the first selection time is a 0th occupied time, the second one is a first occupied time, the last one is a fifth occupied time. Further, the display period K of the least significant bit is assumed as 1, which satisfies 1<A=6. FIG. 9 shows the condition of the second weight determination method of the present invention according to the foregoing assumption. The following will explain the process of figuring out the condition shown in FIG. 9.

Firstly, it is assumed that the occupied time of the first bit data, which starts the display, is 0, and the least significant bit is allotted to the first bit data. Also, since the length f(1, K) of the display period of this bit data is 1, the second bit data is provided with the first occupied time. Then, the second bit is allotted to the second bit data, and the length f(2, K) of the display period of the second bit data is determined according to: 1×(1+1)=2, and the occupied time of the third bit data is determined according to the foregoing equations 4 and 5.

$$ROT(A, f(1, K)+f(2, K)) = ROT(6, 1+2) = ROT(6, 3) = 3 \quad (20)$$

Since this occupied time defers from the foregoing 0th occupied time or the first occupied time, the operation goes to the process for the next bit data.

Next, the third bit is allotted to the third bit data, and the length f(3, K) of the display period of the third bit data is determined according to: 1×(1+1+2)=4, and the occupied time of the fourth bit data is determined according to the foregoing equations 6 through 8.

$$ROT\left(A, \sum f(1\sim 3, K)\right) = ROT(6, 1+2+4) \quad (21)$$

-continued $$= ROT(6, 7) = 1$$

Since this occupied time is already occupied, the fourth bit is then used instead of the third bit, and the length f(3, K) of the display period is determined according to: 1×(1+1+2+4)=8, and the occupied time of the fourth bit data is again determined according to the foregoing equations 6 through 8.

$$ROT\left(A, \sum f(1 \sim 3, K)\right) = ROT(6, 1+2+8) = ROT(6, 11) = 5 \quad (22)$$

Since this occupied time defers from the foregoing 0th occupied time, the first occupied time, and the third occupied time, the operation goes to the process for the next bit data.

Then, the third bit, which was not allotted as the fourth bit data in the previous process, is here used as the fourth bit data, and the length f(4, K) of the display period is determined according to: 1×(1+1+2)=4, and the occupied time of the fifth bit data is determined according to the foregoing equations 6 through 8.

$$ROT\left(A, \sum f(1 \sim 4, K)\right) = ROT(6, 1+2+8+4) = ROT(6, 15) = 3 \quad (23)$$

Since this third occupied time already exists, the fifth bit is then used instead of the third bit, and the length f(4, K) of the display period is determined according to: 1×(1+1+2+4)=16, and the occupied time of the fifth bit data is again determined according to the foregoing equations 6 through 8. Here, the calculation brings the same result as above, i.e., the third occupied time again; thus, the next heavier bit is then used. However, this calculation according to: f(4, K)=1×(1+1+2+4+8+16)=32 brings a result of the first occupied time, which is again already occupied.

At this point, there arises a necessity to reduce one of the lengths of bit data. Thus, the display period of the fourth bit data is reduced to be the length f(3, K) of the display period of the third data, according to: 1×(1+1+2+4−1)=7, and the occupied time of the fourth bit data is again determined according to the foregoing equations 6 through 8.

$$ROT\left(A, \sum f(1 \sim 3, K)\right) = ROT(6, 1+2+7) = ROT(6, 10) = 4 \quad (24)$$

Since this occupied time defers from the foregoing 0th occupied time, the first occupied time, and the third occupied time provided to the first bit data through the third bit data, the operation goes to the process for the next bit data.

Next, the third bit is allotted to the fourth bit data, and the length f(4, K) of the display period of the fourth bit data is determined according to: 1×(1+1+2)=4, and the occupied time of the fifth bit data is determined according to the foregoing equations 6 through 8.

$$ROT\left(A, \sum f(1 \sim 4, K)\right) = ROT(6, 1+2+7+4) = ROT(6, 14) = 2 \quad (25)$$

Since this occupied time defers from the foregoing 0th occupied time, the first occupied time, the third occupied time, and the fourth occupied time provided to the first bit data through the fourth bit data, the operation goes to the process for the next bit data.

Next, the fifth bit is allotted to the fifth bit data, and the length f(5, K) of the display period of the fifth bit data is determined according to: 1×(1+1+2+4+7)=15, and the occupied time of the sixth bit data is determined according to the foregoing equations 6 through 8.

$$ROT\left(A, \sum f(1 \sim 5, K)\right) = ROT(6, 1+2+7+4+15) = ROT(6, 29) = 5 \quad (26)$$

Since this occupied time defers from the foregoing 0th through fifth occupied times provided to the first through fifth bit data, respectively, the operation is completed. As it is shown in the foregoing operation, the 0th through fifth occupied times are all used at last by being provided to the respective six bit data.

Here, when the display period of the sixth bit data is terminated, it is preferable that the sequence again starts from the 0th occupied time, which is provided to the first bit. Accordingly, the sixth bit is allotted to the last sixth bit data, and the length f(6, K) of the display period of the sixth bit is determined according to: f(6, K)=1+6×G=25, so as to satisfy the equation of:

$$ROT\,(A, \Sigma f(1\sim 6, K))=0.$$

This arrangement satisfies the condition for starting sequence again from the first bit (going back again to the 0th occupied time), and here all conditions are prepared.

FIG. 9 shows the condition thus figured out with the foregoing operation. As shown in the figure, the display period of each bit data is 1:2:4:7:15:25.

Note that, in the foregoing condition, the summation of the weights of six bits is: 1+2+4+7+15+25=54. Accordingly, the number of scanning lines may be 9, which is obtained by dividing this number 54 of selection times by the number of bits=6; or, may be 54, which is obtained by adding the bit number=6 to the weight of the first bit so as to obtain the weight of the bit 7:14:28:49:105:175, and by dividing the summation 270 of this ratio by the number of bits=6.

As it has been explained, by determining the weight of data for the first scanning method by using the second weight determination method of the present embodiment, it is possible to realize time division gradation display providing accurate gradation display (for example, 55 gradations), even in an arrangement which does not include an initialization TFT. Note that, a method for creating selecting timings of the scanning lines G1 through G9 in this example having the condition of FIG. 9 should be understood by referring to described Examples 1 and 2. Thus, the description of the selecting timing is omitted here.

EXAMPLE 4

The following will explain an example of determining the occupied time for the second scanning method by using the foregoing second weight determination method. This example uses seven bit data having display period 0. Among these, six bits data are used for display, and the remaining one bit is used as an initialization bit. Since this more preferable example uses seven bit data including an initialization bit, the number of bits is: A=7, and one unit time includes seven selection times. Also, it is determined that the first selection time is a 0th occupied time, the second selection time is a first occupied time, . . . , the last selection time is sixth occupied time. Further, the display period K of the least significant bit is assumed as 1, which satisfies 1<A=7, for simplification. FIG. 11 shows the condition of the second weight determination method of the present invention according to the foregoing assumption. The following will explain the process of figuring out the condition shown in FIG. 9.

Firstly, it is assumed that the occupied time of the first bit data, which starts the display, is 0, and the least significant bit is allotted to the first bit data. Also, since the length f(1, K) of the display period of the first bit data is 1, the second bit data is provided with the first occupied time. Then, the second bit is allotted to the second bit data, and the length f(2, K) of the display period of the second bit data is determined according to: 1×(1+1)=2, and the occupied time of the third bit data is determined according to the foregoing equations 4 and 5.

$$ROT(A, f(1, K) + f(2, K)) = ROT(7, 1+2) = ROT(7, 3) = 3 \quad (28)$$

Since this occupied time defers from the foregoing 0th occupied time and the first occupied time, the operation goes to the process for the next bit data.

Next, the third bit is allotted to the third bit data, and the length f(3, K) of the display period of the third bit data is determined according to: 1×(1+1+2)=4, and the occupied time of the fourth bit data is determined according to the foregoing equations 6 through 8.

$$ROT\left(A, \sum f(1 \sim 3, K)\right) = ROT(7, 1+2+4) = ROT(7, 7) = 0 \quad (29)$$

Since this 0th occupied time is already occupied, the fourth bit is then used instead of the third bit, and the length f(3, K) of the display period is determined according to: 1×(1+1+2+4)=8, and the occupied time of the fourth bit data is again determined according to the foregoing equations 6 through 8.

$$ROT\left(A, \sum f(1 \sim 3, K)\right) = ROT(7, 1+2+8) = ROT(7, 11) = 4 \quad (30)$$

Since this occupied time defers from the foregoing 0th occupied time, the first occupied time, and the third occupied time, the operation goes to the process for the next bit data.

Then, the third bit, which was not adopted as the fourth bit data in the previous process is here used as the fourth bit data, and the length f(4, K) of the display period is determined according to: 1×(1+1+2)=4, and the occupied time of the fifth bit data is determined according to the foregoing equations 6 through 8.

$$ROT\left(A, \sum f(1 \sim 4, K)\right) = ROT(7, 1+2+8+4) = ROT(7, 15) = 1 \quad (31)$$

Since this first occupied time already exists, the next heavier bit is then used as the fourth bit, and the length f(4, K) of the display period is determined according to: 1×(1+1+2+4)=16, and the occupied time of the fifth bit data is again checked according to the foregoing equations 6 through 8.

$$ROT\left(A, \sum f(1 \sim 4, K)\right) = ROT(7, 1+2+8+16) = ROT(7, 27) = 6 \quad (32)$$

Since this occupied time defers from the foregoing 0th occupied time, the first occupied time, and the third occupied time, the operation goes to the process for the next bit data.

Then, the third bit, which was not adopted as the fifth bit data in the previous process is here used as the fifth bit data, and the length f(5, K) of the display period is determined according to: 1×(1+1+2)=4, and the occupied time of the sixth bit data is determined according to the foregoing equations 6 through 8.

$$ROT\left(A, \sum f(1 \sim 5, K)\right) = ROT(7, 1+2+8+16+4) = ROT(7, 31) = 3 \quad (33)$$

Since this third occupied time already exists, the operation carries on as follows (*the description of each process is omitted). The length f(4, K) of the display period of the fourth bit data is determined as 15, and the occupied time of the fifth bit data is again determined according to the foregoing equations 6 through 8.

$$ROT\left(A, \sum f(1 \sim 4, K)\right) = ROT(7, 1+2+8+15) = ROT(7, 26) = 5 \quad (34)$$

Further, the occupied time of the sixth bit data is determined as follows according to the foregoing equations 6 through 8.

$$ROT(A, \Sigma f(1 \sim 5, K)) = ROT(7, 1+2+8+15+4) \quad (35)$$
$$= ROT(7, 30) = 2$$

Further, the length f(6, K) of the display period of the sixth bit data is determined according to: 1×(1+1+2+8+15+4)=31; then, since only the sixth occupied time is left, i.e., it has not been provided to any of the respective bit data, the occupied time of the seventh bit data (initialization bit) is required to be as follows.

$$ROT(A, \Sigma f(1 \sim 6, K)) = ROT(7, 1+2+8+15+4+f(6, K)) \quad (36)$$
$$= ROT(7, 30 + f(6, K)) = 6$$

Accordingly, it is determined that f(6, K)=25. Since the last seventh bit is the initialization bit, the time when the display period of the seventh bit data is terminated does not need to be taken into account. However, it should be noted that, the number of scanning lines is required to be greater than the value obtained by dividing the summation (1+2+8+15+4+25=55) of the display periods of the first bit through sixth bit by the number of bits=7, which will be 7.8. Accordingly, the number of scanning lines is not less than 8.

Figure 27:
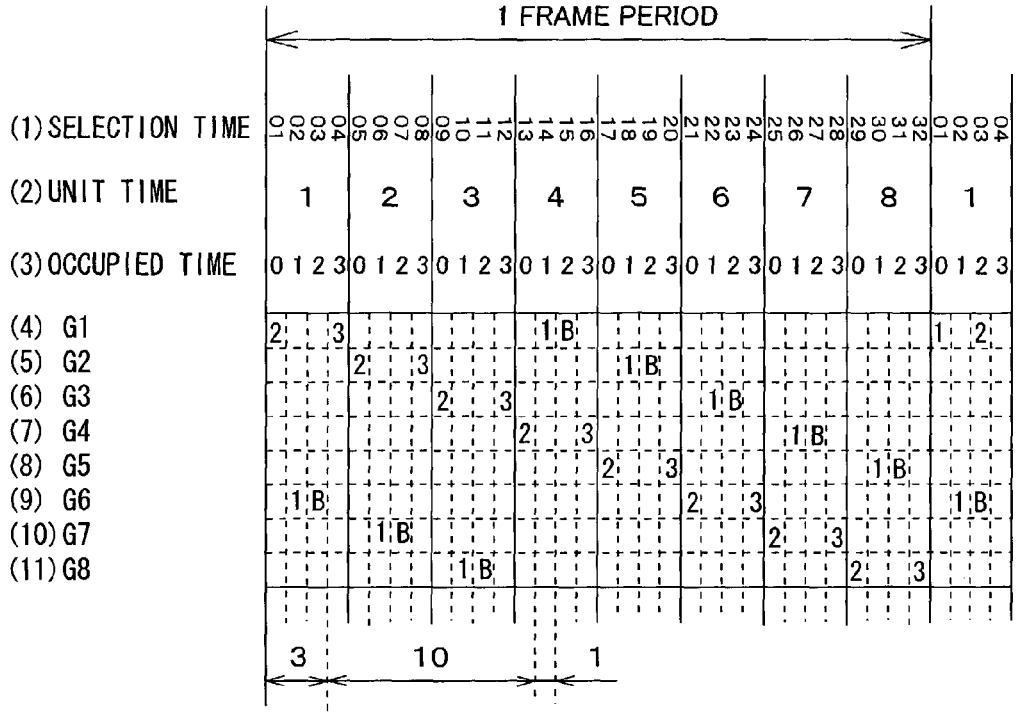
FIG. 27 is a timing diagram showing a scanning method of time division gradation, which is realized by using the scanning condition shown in FIG. 26.

Then, all factors of the condition are prepared, and the condition shown in FIG. 11 is created. As shown in the figure, the display period of each bit data is 1:2:4:8:15:25:0, and 56-gradation display can be obtained. By thus changing the order of the weights of displayed bits, it is possible to provide more preferable effect of an increase of gradation display capability compared to the case using the condition of FIG. 7 realizing 51 gradations based on the weight ratio of 1:2:3:6:13:26:0, which was obtained according to the first determination method. Further, FIG. 26 shows the condition of the weight of bit where R=4 and A=4, as another example of determining the weight for the second scanning method by using the second weight determination method. Also, FIG. 27 shows the scanning timing in this case.

EXAMPLE 5

The following will explain a more preferable example of the first and second weight determination methods (determination methods of occupied times). This example uses seven bit data. Among these, six bits data are used for display, and the remaining one bit is used as an initialization bit. Since this example uses seven bit data including an initialization bit, the number of bits is: A=7, and one unit time includes seven selection times. Also, it is assumed that the first selection time is a 0th occupied time, the next one is a first occupied time, . . . , the last one is sixth occupied time. Further, the display period K of the least significant bit is assumed to be 1, which satisfies 1<A=7. FIG. 12 shows the condition of the more preferable weight determination method of the present invention according to the assumptions. The following will explain the process of figuring out the condition shown in FIG. 12.

The determination method (the third weight determination method) of the present example is substantially the same as the first or the second determination method, except for the arrangement in which, among the A bit data to be sequentially supplied to the data line, two bit data of close weights are provided so that these two data are away from each other in the same frame period.

The following will explain an example of the foregoing third weight determination method in which the most significant and the second most significant bit data are provided at the beginning and at the end of one frame period. According to the foregoing weight ratio, the most significant and the second most significant bit data are the fifth bit and the sixth bit. Thus, the fifth bit is allotted as the first bit data, which starts the display, and provided with the 0th occupied time. It is assumed that the length of display period of the least significant bit data is 1, and therefore the length f(1, K) of the display period of the first bit data is determined as 16, and the occupied time of the first bit data is determined according to the foregoing equations.

$$ROT(7, f(1, K)) = ROT(7, K) = 2 \quad (37)$$

Thus, the second occupied time is provided to the second bit data.

Here, the total length of the display periods of the least significant bit through the third bit is: 1+2+4=7, and the total length of the display periods of the second bit through the fourth bit is: 2+4+8=14, and these total values are both multiples of 7. By taking this account, some different combinations are reviewed; and then, it is determined that the second bit is allotted to the second bit data as a result of the review.

Then, it is assumed that the length f(2, K) of the display period of the second bit data is determined according to: 1×(1+1)=2, and the occupied time of the third bit data is checked according to the foregoing equations 4 and 5.

$$ROT(A, f(1, K) + f(2, K)) = ROT(7, 16+2) \quad (38)$$
$$= ROT(7, 18) = 4$$

Since this occupied time defers from the foregoing 0th occupied time and the second occupied time, the operation goes to the process for the next bit data. Hereinafter, minute description of examination process for selecting the bit is omitted in the explanation.

The fourth bit is allotted to the third bit data, and the length f(3, K) of the display period of the third bit data is determined according to: 1×(1+1+2+4)=8, and the occupied time of the fourth bit data is checked according to the foregoing equations 6 through 8.

$$ROT(A, \Sigma f(1 \sim 3, K)) = ROT(7, 16+2+8) \quad (39)$$
$$= ROT(7, 26) = 5$$

Since this occupied time defers from the foregoing 0th, the second, and the fourth occupied time, the operation goes to the process for the next bit data.

The first bit is allotted to the fourth bit data, and the length f(4, K) of the display period of the fourth bit data is assumed to be 1, and the occupied time of the fifth bit data is determined according to the foregoing equations 6 through 8.

$$ROT(A, \Sigma f(1 \sim 4, K)) = ROT(7, 16+2+8+1) \quad (40)$$
$$= ROT(7, 27) = 6$$

Since this occupied time defers from the foregoing 0th, the second, the fourth, and the fifth occupied time, the operation goes to the process for the next bit data.

The third bit is allotted to the fifth bit data, and the length f(5, K) of the display period of the third bit data is determined according to: 1×(1+1+2)=4, and the occupied time of the sixth bit data is checked according to the foregoing equations 6 through 8.

$$ROT(A, \Sigma f(1 \sim 5, K)) = ROT(7, 16+2+8+1+4) \quad (41)$$
$$= ROT(7, 31) = 3$$

Since this occupied time defers from the foregoing 0th, the second, the fourth, the fifth, or the sixth occupied time, the operation goes to the process for the next bit data.

The sixth bit is allotted to the sixth bit data, and the length f(6, K) of the display period of the sixth bit data is determined according to: 1×(1+1+2+4+8+16)=32. Here, since only the first occupied time is left, i.e., it has not been provided to any of the respective bit data, the occupied time of the seventh bit data is required to be as follows.

$$ROT(A, \Sigma f(1 \sim 6, K)) = ROT(7, 16+2+8+1+4+f(6, K)) \quad (42)$$
$$= ROT(7, 31+f(6, K) = 1$$

Accordingly, it is determined that f(6, K)=26. Since the last seventh bit is the initialization bit, the time when the display period of the seventh bit data is terminated does not need to be taken into account. However, it should be noted that, the number of scanning lines is required to be greater than the value obtained by dividing the summation (16+2+8+1+4+26=57) of the display periods of the first bit through sixth bit by the number of bits 7, which will be 8.1. Accordingly, the number of scanning lines is not less than 9.

Further, in the foregoing condition, if the weight of the first bit is assumed to be 2, the weight ratio of the bits is 32:4:16:2:8:52:0 (in this case, the respective positions of the seven bits are the 0th, the fourth, the first, the third, the fifth, the sixth, the second, in terms of their occupied times). In this case, the summation of the display periods is not less than 16.2, according to:

32+4+16+2+8+52=114/7(=number of bits)=16.2.

Further, in the foregoing condition, if the weight of the first bit is assumed to be 3, the weight ratio of the bits is 4:8:6:24:3:12:78:0 (in this case, the respective positions of the seven bits are the 0th, the sixth, the fifth, the first, the fourth, the second, the third, in terms of their occupied times). Further, in the foregoing condition, if the weight of the first bit is assumed to be 4, the weight ratio of the bits is 64:8:32:4:16:104:0 (in this case, the respective positions of the seven bits are the 0th, the first, the second, the sixth, the third, the fifth, the fourth, in terms of their occupied times). Further, in the foregoing condition, if the weight of the first bit is decided as 5, the weight ratio of the bits is 80:10:40:5:20:150:0 (in this case, the respective positions of the seven bits are the 0th, the third, the sixth, the fourth, the second, the first, the fifth, in terms of their occupied times). Further, in the foregoing condition, if the weight of the first bit is assumed to be 6, the weight ratio of the bits is 91:12:48:6:24:156:0 (in this case, the respective positions of the seven bits are the 0th, the fifth, the third, the second, the first, the fourth, the sixth, in terms of their occupied times). As thus described, the arrangement of adding 7 to the weight of the least significant bit may be applied to all of the foregoing cases, and therefore many of the scanning lines can be used for these arrangements.

As with the foregoing arrangement, it is also possible to adjust the most significant and the second most significant bit data, which are provided respectively at the beginning and the end of one frame period. On this account, more flexible selecting timings can be obtained. As a result, it becomes possible to freely decide the number of scanning lines for one control group, up to a certain level, thereby carrying out time division gradation display in accordance with the number of scanning lines of the display panel.

Further, the size of dynamic false contour which occurs in the display is proportional to the size of the most significant bit. Accordingly, the weight of the most significant bit is adjusted to be not more than about 1.5 times of that of the second most significant bit, so as to decrease the largest gradation level, and also to suppress the dynamic false contour, which occurs when the viewer's eyes follow a moving image.

Further, in the weight of bit used in the second scanning method determined by the foregoing weight determination method, it is possible to provide a plurality of bit patterns for displaying halftones. For example, Table 1 shows two types of bit pattern appearing between the gradation levels of from 26 to 31, when the ratio of the weight of bit is 2:16:8:1:4:26.

TABLE 1

| PATTERN A | | | | | | | PATTERN B | | | | | |
|---|---|---|---|---|---|---|---|---|---|---|---|---|
| 2 | 5 | 4 | 1 | 3 | 6 | BIT NUMBER | 2 | 5 | 4 | 1 | 3 | 6 |
| 2 | 16 | 8 | 1 | 4 | 26 | WEIGHT OF BIT | 2 | 16 | 8 | 1 | 4 | 26 |
| ▪ | ▪ | ▪ | ▪ | ▪ | ▪ | GRADATION LEVEL | ▪ | ▪ | ▪ | ▪ | ▪ | ▪ |
| | 0 | 0 | | | | 24 | | 0 | 0 | | | |
| | 0 | 0 | 0 | | | 25 | | 0 | 0 | 0 | | |
| 0 | 0 | 0 | | | | 26 | | | | | | 0 |
| 0 | 0 | 0 | 0 | | | 27 | | | | 0 | | 0 |
| | 0 | 0 | | 0 | | 28 | 0 | | | | | 0 |
| | 0 | 0 | 0 | 0 | | 29 | 0 | | | 0 | | 0 |
| 0 | 0 | 0 | | 0 | | 30 | | | | | 0 | 0 |
| 0 | 0 | 0 | 0 | 0 | | 31 | | | | 0 | 0 | 0 |
| 0 | | | 0 | 0 | 0 | 32 | 0 | | | | 0 | 0 |
| 0 | | | 0 | 0 | 0 | 33 | 0 | | | 0 | 0 | 0 |
| | | 0 | | | 0 | 34 | | | 0 | | | 0 |
| ▪ | ▪ | ▪ | ▪ | ▪ | ▪ | ▪▪▪ | ▪ | ▪ | ▪ | ▪ | ▪ | ▪ |

In the example of Table 1, the gradation level for starting lighting the sixth bit may be selected in a range from 26 to 31. The dynamic false contour most significantly occurs in this gradation pattern for causing the sixth bit to light; therefore, it is possible to suppress the dynamic false contour by respectively lighting the bit data in different patterns from each other, when adjacent electro-optic elements display the same gradation in the same frame period via a plurality of gradation transition levels.

Figure 13:
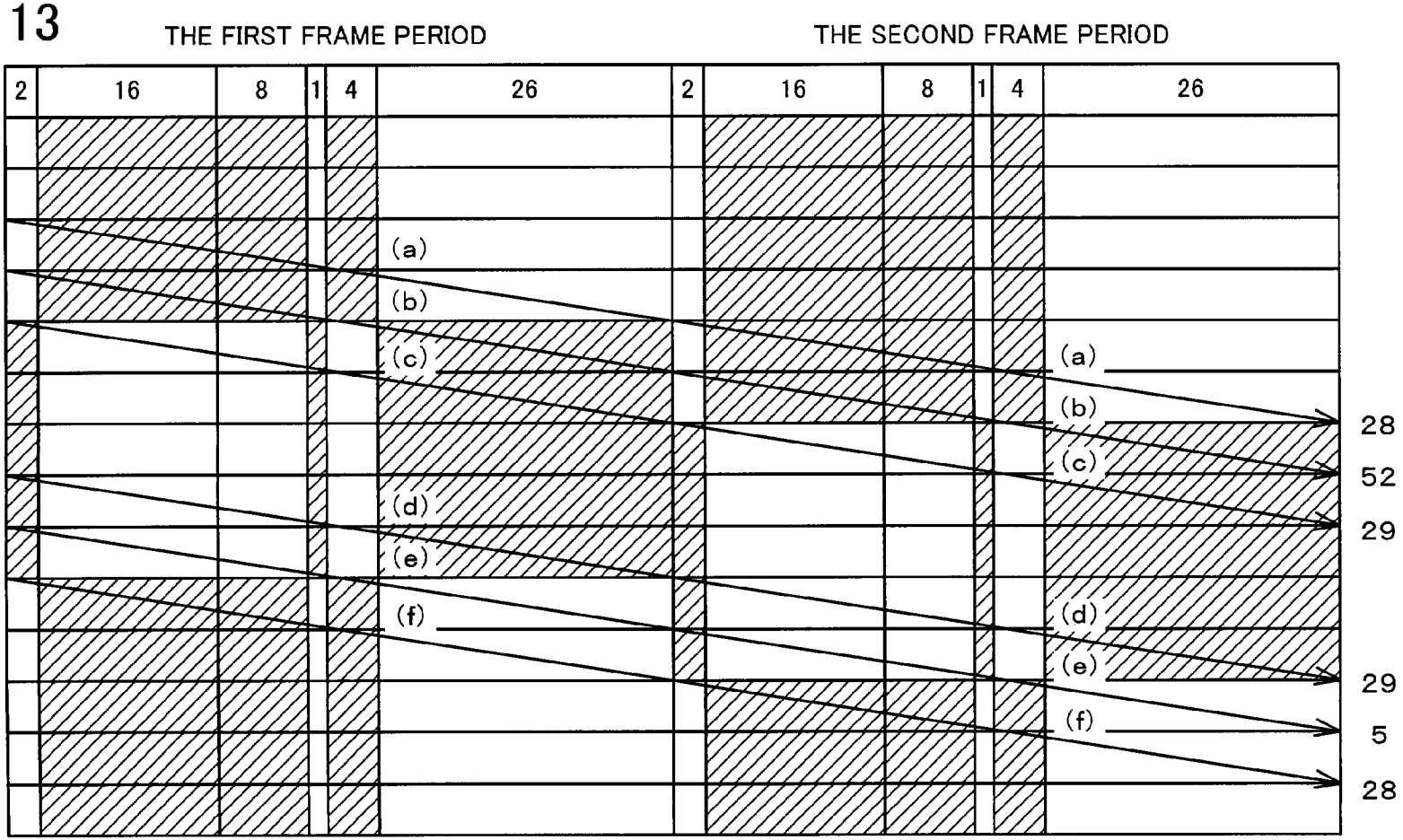
FIG. 13 is an explanatory view showing a principle for causing dynamic false contour, in the scanning condition shown in FIG. 12.

FIG. 13 shows the bit data in case where the image of gradation level 29 crosses over the background of gradation level 28. This example has only one gradation transition level, and in this example, the gradation transition pattern A is replaced with the gradation transition pattern B, which are shown in Table 1, from the gradation level 28 to the gradation level 29. In this figure, the horizontal axis denotes time, and the vertical axis denotes the movement direction of images. In this case, when the viewer's eyes follow the image in a direction denoted by arrows (a) through (f), the viewer sees the gradation, which actually not shown on the screen, such as the gradation denoted by (b) or (e) in the figure. This is referred to as dynamic false contour. In view of circumstances, it is possible to suppress the occurrence of the dynamic false contour shown in FIG. 13, by changing the gradation level, which causes the transition from the gradation transition pattern A to B.

Further, in FIG. 13, a gradation error in a bright luminance direction occurs in one side ((b) side) of the movement direction, and a gradation error in a dark luminance direction occurs in the other side ((e) side) of the movement direction. In such a case, as shown in FIG. 14, by alternately using the two gradation patterns shown in Table 1, as the gradation levels 28 or 29, it is possible to suppress the phenomenon in which only one side of the movement direction becomes lighter or darker.

Note that, in the foregoing example, when the electro-optic elements adjacent to each other display the same gradation, these elements are driven by lighting the bit data respectively in different patterns from each other; however, the present invention is not limited to this arrangement. The foregoing arrangement yet provides the effect to a certain extent, since the arrangement capable of suppressing the unwanted effect that only one side of the movement direction becomes lighter or darker, by providing a plurality of patterns for the respective bit data so as to vary the bit data from each other, when adjacent electro-optic elements display the same gradation in the same frame period.

When carrying out the driving so that a plurality of lighting bit patterns are different from each other, in the case where adjacent electro-optic elements display the same gradation, the bright and dark luminances are counterbalanced in terms of 2-pixel unit, thus further suppressing the dynamic false contour. Since human's eyes have low resolution with respect to a moving image, it is effective to adopt such a method for suppressing the dynamic false contour.

Figure 14:
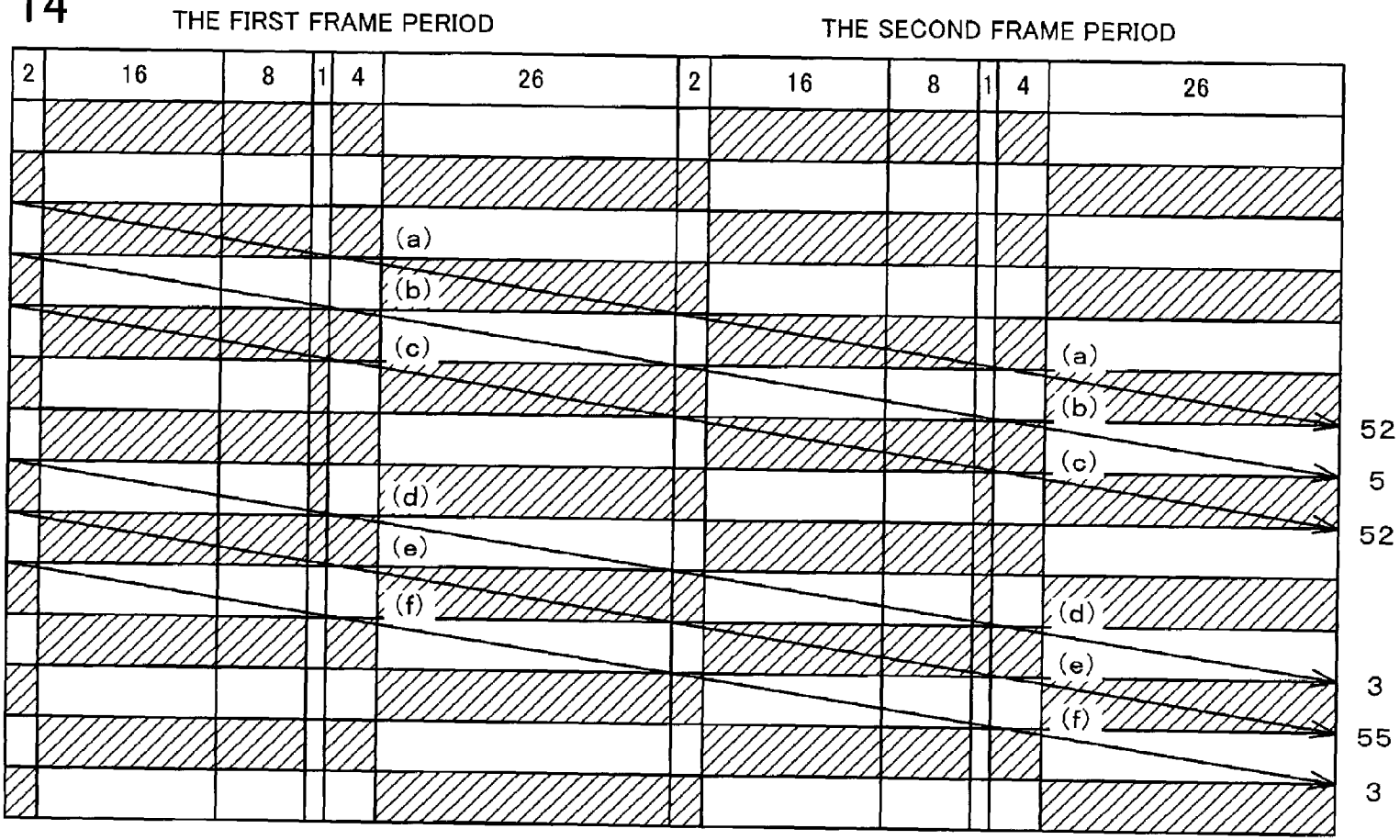
FIG. 14 is an explanatory view showing an effect for suppressing the dynamic false contour, in the scanning condition shown in FIG. 12.
Figure 16:
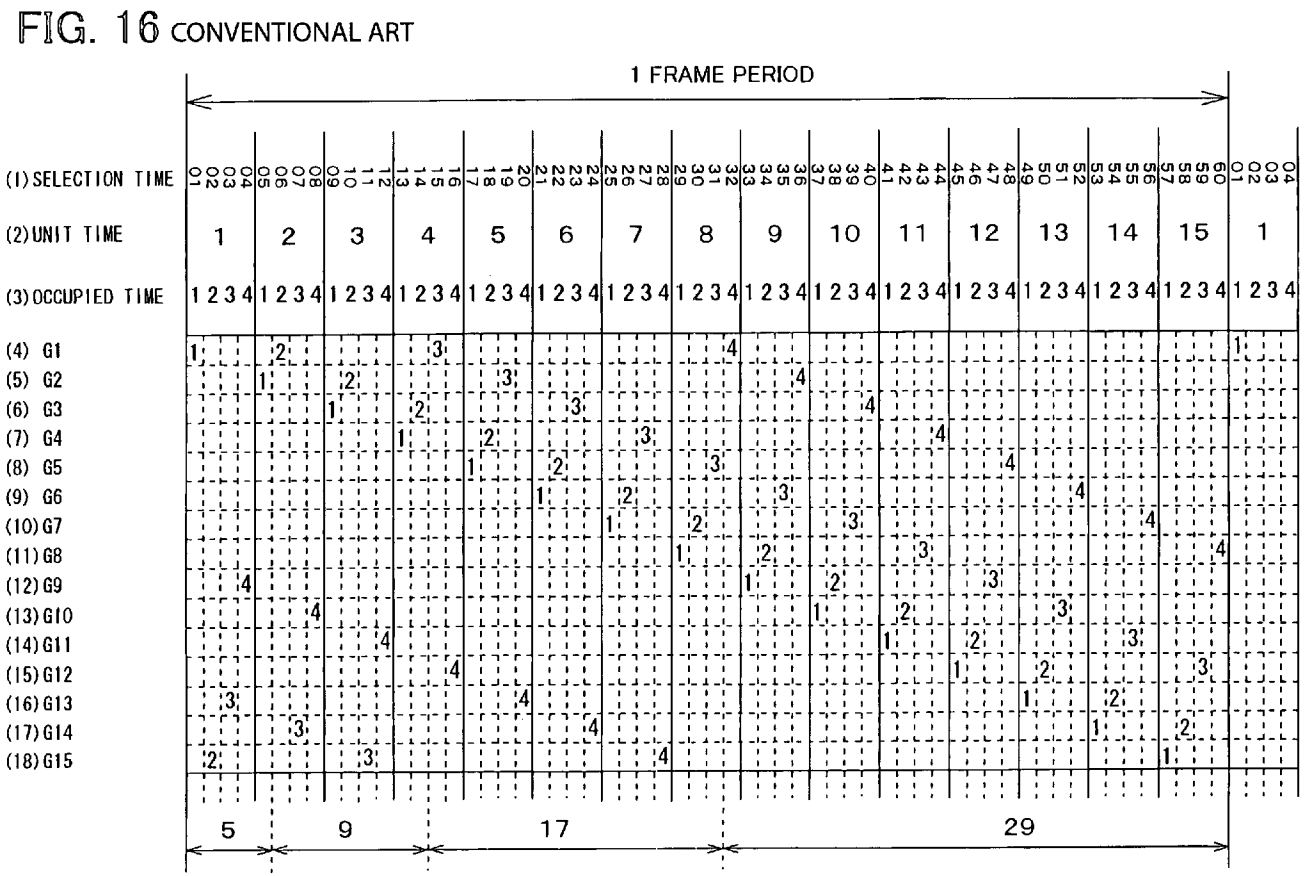
FIG. 16 CONVENTIONAL ART
FIG. 16 is a timing diagram showing a scanning method of time division gradation using a typical conventional technique.

Note that, as with the example of FIG. 14, when the gradation transition pattern is fixed in each pixel, or the pattern is periodically and regularly switched, the viewer's eyes catch the pattern fixed by the gradation transition pattern, at the time of following a moving image. Accordingly, it is preferable that the switching of the transition pattern is performed at random.

Further, a method for extending the display period of the bit having the weight of 0 may be used as another method for suppressing the dynamic false contour.

More specifically, the foregoing example of FIG. 13 assumes that the occupancy rate of the display period of the bit having the weight of 0 is substantially 0 in one frame period; however, in the second scanning method of the present embodiment, the occupancy rate of the display period of the bit having the weight of 0 may be freely set to some extent, thus extending the occupancy rate of the display period of the bit having the weight of 0. For example, in an example shown in FIG. 28, the occupancy rate of the display period of the bit having the weight of 0 is adjusted to be ⅓ of one frame period, and amount of emergence of the dynamic false contour is considered, as with the example of FIG. 13.

Figure 28:
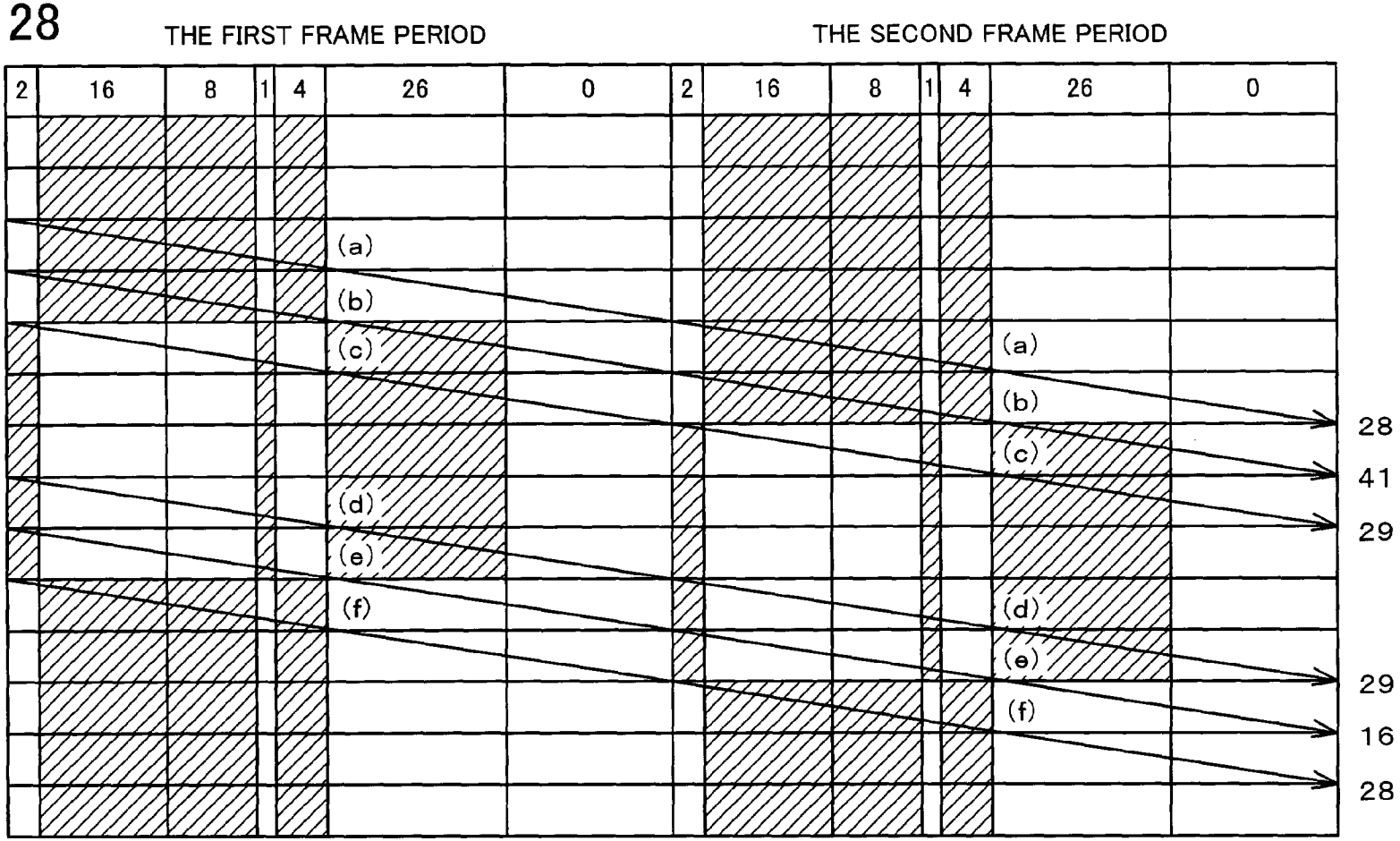
FIG. 28 is an explanatory view showing an effect in the case of suppressing the dynamic false contour by extending the display period of a bit having the weight of 0.

As it can be seen in the comparison between FIG. 28 and FIG. 13, the size of the dynamic false contour is 52−29=23 in FIG. 13, and 41−29=12 in FIG. 28.

Note that, in the case of extending the occupancy rate of the display period of the bit having the weight of 0, it is not required to provide the most significant and the second most significant bit s to be away from each other in their display period as with the example of FIG. 12, but they may be adjacent to each other as with the example of FIG. 9. Here, Table 2 shows two raising patterns in the example of FIG. 9. Note that, as with the example of Table 1, the two raising patterns are not required to occur in pixels adjacent to each other, but they may occur at random.

TABLE 2

| PATTERN A | | | | | | | PATTERN B | | | | | |
|---|---|---|---|---|---|---|---|---|---|---|---|---|
| 1 | 2 | 4 | 3 | 5 | 6 | BIT NUMBER | 1 | 2 | 4 | 3 | 5 | 6 |
| 1 | 2 | 7 | 4 | 15 | 25 | WEIGHT OF BIT | 1 | 2 | 7 | 4 | 15 | 25 |
| ■ | ■ | ■ | ■ | ■ | ■ | GRADATION LEVEL | ■ | ■ | ■ | ■ | ■ | ■ |
| 0 | 0 | | 0 | 0 | | 22 | 0 | 0 | | 0 | 0 | |
| 0 | | 0 | | 0 | | 23 | 0 | | 0 | | 0 | |
| | 0 | 0 | | 0 | | 24 | | 0 | 0 | | 0 | |
| 0 | 0 | 0 | | 0 | | 25 | | | | | | 0 |
| | | 0 | 0 | 0 | | 26 | 0 | | | | | 0 |
| 0 | | 0 | 0 | 0 | | 27 | | 0 | | | | 0 |
| | 0 | 0 | 0 | 0 | | 28 | 0 | 0 | | | | 0 |
| 0 | 0 | 0 | 0 | 0 | | 29 | | | | 0 | | 0 |
| 0 | | | 0 | | 0 | 30 | 0 | | | 0 | | 0 |
| | 0 | | 0 | | 0 | 31 | | 0 | | 0 | | 0 |
| 0 | 0 | | 0 | | 0 | 32 | 0 | 0 | | 0 | | 0 |

As described, it is effective to extend the occupancy rate of the display period of the bit having the weight of 0, or to reduce the rate of emitting period, for suppressing the dynamic false contour. Especially, by adjusting the display period of the data having the weight of 0 to be not less than ¼ of one frame period, it is possible to reduce the overlapping of the emitting periods of the bit data, which occurs when the viewer's eyes follow a moving image displayed by the time division display, thereby suppressing the occurrence of the dynamic false contour.

Note that, as described above, in the second scanning method of the present embodiment, the occupancy rate of the display period of the bit having the weight of 0 may be freely set to some extent without strictly limiting the type of the pixel array 12 which can be driven. Accordingly, by extending the occupancy rate of the display period of the bit having the weight of 0 in the second scanning method of the present embodiment, it is possible to suppress the dynamic false contour without strictly limiting the type of the pixel array 12 which can be driven.

Further, degradation property of organic EL does not dramatically change even when the luminance becomes approximately twice so as to make up for the reduction of the emitting period, which is cut down to approximately ½, provided that the average luminance per unit area stays the same. Therefore, when carrying out the time division gradation display with respect to the organic EL, by adjusting, in accordance with the second scanning method, the occupancy rate of the display period of the bit having the weight of 0 to be approximately in a range between ¼ and ¾ of one frame period, it is possible to suppress the occurrence of the dynamic false contour, without strictly limiting the type of the pixel array 12 which can be driven in the arrangement, also while maintaining the degradation property of the organic EL at the same level as that in the case where the bit having the weight of 0 is not provided. Note that, in the second-scanning method, as described, since the occupancy rate of the display period of the bit having the weight of 0 may be freely set to some extent, the pixel array 12 can be driven with no difficulties even when the occupancy rate of the display period of the bit having the weight of 0 is set to be approximately in a range between ¼ and ¾ of one frame period.

Note that, FIG. 15 shows an example of the weights of bits used for the second scanning method, and determined by using the described third weight determination method (the method in which two bit data of close weights are provided to be away from each other in the same frame period). Specifically, the condition shown in the figure is found for a case of performing 8 bits gradation display (the number of bits including an initialization bit is A=9).

Further, FIG. 29 shows an example of the weights of bits used for the second scanning method, and determined by using the second weight determination method, and also adjusting the display period of the bit having the weight of 0 to be about ½ of one frame period. Specifically, the condition shown in the figure is found for a case of performing 8 bits gradation display (the number of bits including an initialization bit is A=9).

Here, for example, when the first and second scanning methods are carried out with the weights of bits, which are, for example, determined by the first or second weight determination method of the present embodiment, the gradation number B is decreased compared to the case where $R^A$=B is set; however, the rate of the decrease of the gradation number is reduced, as the number of bits increases. For example, in the example of FIG. 29, the number of displayable gradations is 250, which is covering 97.7% of the number of gradations 256, which is displayable in an 8 bits arrangement.

Here, the following will briefly explain an arrangement example of the control circuit 16 for controlling the data line driving circuit 13 and the scanning line driving circuit 14 by using the first or second scanning method of the present embodiments. It is assumed that the driving is carried out with the timing shown in FIG. 23. In this case, the two bit data corresponding to the scanning line G1 are respectively described as g1(1) and g2(2) in order of lighter to heavier weight, and each bit data is outputted in the following order: g1(1), g6(2), g2(1), g1(2), g3(1), g2(2), g4(1), g3(2), g5(1), g4(2), g6(1), g5(2), with respect to a given data line.

Meanwhile, when image data D corresponding to each scanning line are described as image data D(1) through D(6), the control circuit 16 shown in FIG. 21 is supplied with these image data D(1) to D(6) in this order, respectively as image signals DAT.

Figure 30:
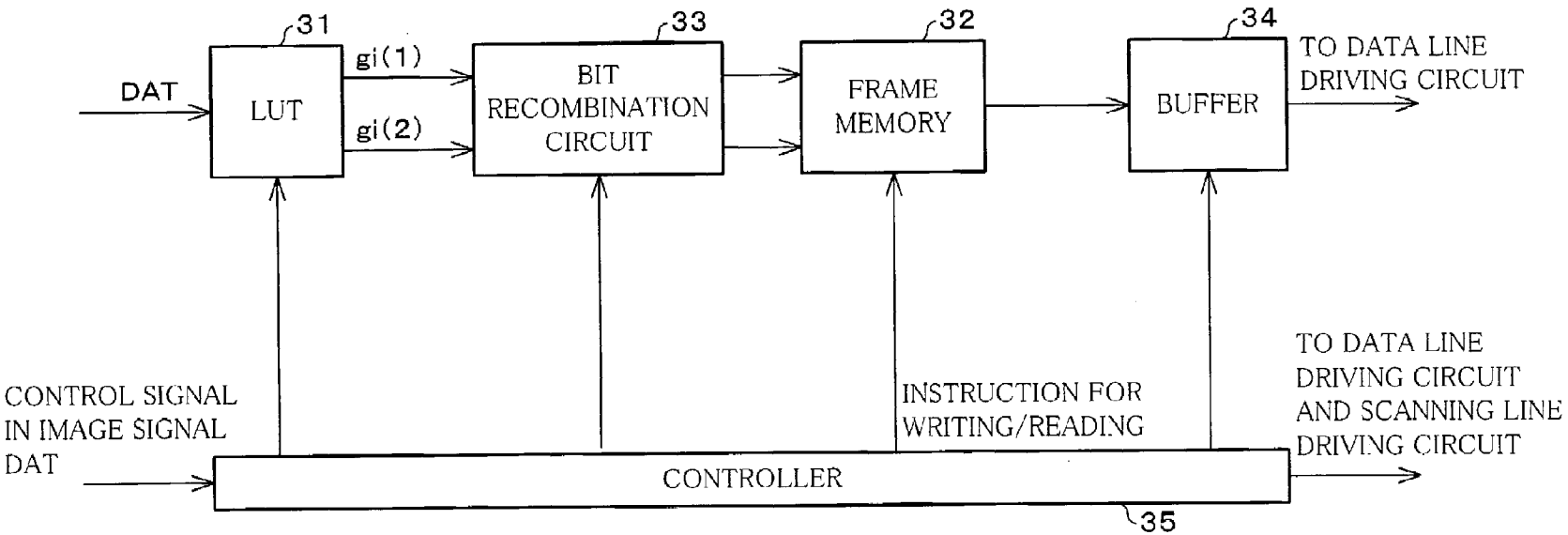
FIG. 30 is a block diagram showing an arrangement example of a control circuit in a display device according to the present embodiment.

Meanwhile, as shown in FIG. 30, the control circuit 16 includes a LUT (Look Up Table) 31 to which the image data D constituting the image signal DAT is supplied, a frame memory 32 which stores bit data for one frame, a bit recombination circuit 33 for arranging the outputs of the LUT 31 by assorting the bit data in different groups so that the bit data are easily read out from the frame memory 32, a buffer 34 for buffering the output of the frame memory 32 so as to supply the data to the data line driving circuit 13, a controller 35 for controlling the foregoing members 31 through 34 based on a control signal (such as a clock signal or a synchronization signal) in the image signal DAT. Note that, in this arrangement example, the frame memory 32 is made of a RAM (Random Access Memory).

The LUT (Look Up Table) 31 outputs the respective image data D (i) (i is an arbitrary number not more than 6) by converting these image data into bit data gi(1) and gi(2). Further, the bit recombination circuit 33 arranges and outputs the bit data gi(1) and gi(2) by assorting them in different groups. Further, the frame memory 32 stores the bit data gi(1) and gi(2) outputted from the bit recombination circuit 33 in the separate storage areas respectively corresponding to these data, in accordance with storing instruction from the controller 35.

Meanwhile, the controller 35 controls the frame memory 32 so that the respective bit data are outputted from the frame memory 32 in a predetermined order, i.e., the order of g1(1), g6(2), g2(1), g1(2), g3(1), g2(2), g4(1), g3(2), g5(1), g4(2), g6(1), g5(2). This control operation is performed, for example, by providing readout addresses indicating the storage areas of the respective bit data, in the foregoing order. With this operation, the respective bit data are outputted to the data line control circuit 13 in the foregoing order.

Further, the controller 35 transmits the control signal to the data line driving circuit 13 so that the timing for outputting each bit data is synchronized with the timing for reading out the bit data by the data line driving circuit 13. Further, the controller 35 transmits the control signal also to the scanning line driving circuit 14 so that the timing for outputting each bit data is synchronized with the timing for selecting the scanning line corresponding to the bit data. This operation allows the display device 11 shown in FIG. 21 to drive the pixel array 12 by the first or second scanning methods of the present embodiment.

Note that, the foregoing example uses a matrix-type display device; however, the present invention is not limited to this type of display device. For example, a driving device such as a liquid-crystal shutter for use in an image-forming device may also be adopted. The same effect as that of the present embodiment can be obtained by using a driving device for an electro-optic device having the following configuration (1) or (2).

(1) A driving device for driving an electro-optic device including electro-optic elements capable of R-stage output (R being an integer not less than 2), the electro-optic elements being provided for each combination of a plurality of scanning lines and at least one data line, including: a driving section for supplying instruction data, which instructs outputs in an output period before a next instruction data is supplied, to the electro-optic elements corresponding to the scanning line currently selected among the plurality of scanning lines sequentially selected, the driving section supplying the instruction data to the electro-optic element via the data line corresponding to the electro-optic element, wherein the driving section supplies A instruction data A times (A being an integer not less than 2) in the one frame period for each electro-optic element so as to control outputs in one frame period performed as an output of the electro-optic elements over the one frame period, and selects the scanning lines so that each of the instruction data B1 through Ba appears once in A instruction data to be sequentially supplied to the data line.

(2) A driving device for driving an electro-optic device including electro-optic elements capable of R-stage output (R being an integer not less than 2), the electro-optic elements being provided for each combination of a plurality of scanning lines and at least one data line, including: a driving section for supplying instruction data, which instructs outputs in an output period before a next instruction data is supplied, to the electro-optic elements corresponding to the scanning line currently selected among the plurality of scanning lines sequentially selected, the driving section supplying the instruction data to the electro-optic element via the data line corresponding to the electro-optic element, wherein the driving section supplies the instruction data so that the A instruction data supplied to an electro-optic element in one frame period has a different timing from that of other A instruction data supplied to other electro-optic elements of the same data line in one frame period; and when the A instruction data are discriminated with identification numbers showing the order to be supplied to the electro-optic elements, the driving section supplies the instruction data so that each of the A instruction data sequentially supplied to a data line has a different identification number from each other.

However, in a display device, the required number of scanning lines changes according to the target resolution, and therefore respective display devices includes different numbers of scanning lines in their configurations. Further, the number of gradations displayable over one frame period tends to be set to a relatively large value, such as 256 gradation for red color, in response to the recent demand for multi-gradation display. Accordingly, even when the number B of outputs in a frame period is set to a smaller value than $R^A$ so that the respective outputs in a frame period become their target values at respective gradations (at respective stages), degradation of the displayed image due to the decrease of the number of gradations seldom occurs. On these accounts, a superior effect is ensured in the use of the present invention for a display device.

As described, the present invention solves the conventional problems by degeneracy from power of 2 with regard to the weight ratio of the respective bits required for multi-gradation display by changing appearance order of the bits, or by replacement by blanking display data.

Namely, as described, a driving device for driving an electro-optic device according to the present invention has an arrangement such that: the scanning lines are selected so that each of the instruction data B1 through Ba appears once in A instruction data to be sequentially supplied to the data line, and the outputs in one frame period performed as an output of the electro-optic elements capable of R-stage output (R is an integer not less than 2) over the one frame period is controlled so that the instruction data B1 through Ba are supplied A times (A is an integer not less than 2) in the one frame period for each electro-optic element, in an output period before a next instruction data is supplied, to the electro-optic elements corresponding to the scanning line currently selected, via the data line corresponding to the electro-optic element. This arrangement allows the driving device to realize B-stage output in one frame period performed as output operation of the electro-optic elements. Further, the driving device is arranged so that the weight of each bit data is adjusted to satisfy $R^A>B$.

Therefore, in comparison with the arrangement of setting the weight of each instruction data so as to realize the relation of $B=R^A$, this arrangement can increase the number of scanning lines capable of setting each gradation level to be a target value. As a result, the range of the electro-optic device in which the target gradation can be set with respect to each stage output can further be enlarged over one frame-period.

As described, in addition to the foregoing arrangement, the driving device for driving an electro-optic device according to the present invention has such an arrangement that the weights of the respective instruction data to be supplied in the one frame period are set so that a pair of the instruction data whose weight ratio satisfies G: (G×R−n) is included among pairs of the instruction data adjacent to each other when the instruction data are aligned in order of lighter to heavier weight, where G is an integer not less than 1 and n is an integer not less than 1 and not more than G×(R−1).

Also in this arrangement, the weight of each bit data is adjusted to satisfy $R^A>B$, thus providing an effect such that the range of the electro-optic device in which the target gradation can be set with respect to each stage output can further be enlarged over one frame period.

As described, in addition to the foregoing arrangement of having a pair of the instruction data adjacent to each other whose weight ratio satisfies G: G×R−n, the driving device for driving an electro-optic device according to the present invention has such an arrangement that at least one of the instruction data to be supplied to the electro-optic elements in the one frame period is set to 0 in the weight.

In this arrangement, the foregoing equation $R^A>B$ is satisfied since at least one of the instruction data is set to 0 in the weight. Further, since one of the instruction data is set to 0 in the weight, it is not necessary to carry our initialization scanning apart from the scanning operation for supplying the instruction data to the electro-optic elements. Further, by having the weight of 0, change of the length of the output period corresponding to the instruction data having the weight of 0 does not affect the outputs in the frame period. Accordingly it is possible to adjust the length of the output period corresponding to the instruction data having the weight of 0 so that each of the instruction data corresponding to a different scanning line has a different timing (selection time) for being supplied to the data line, without changing the value of the respective stages of the outputs in the frame period, while providing an length of the output period appropriate for the number of scanning lines. As a result, the range of the electro-optic device in which the target gradation can be set with respect to each stage output can further be enlarged over one frame period.

As described, in addition to the foregoing arrangement, the driving device for driving an electro-optic device according to the present invention has such an arrangement that order of the A instruction data to be supplied to the data line in the one frame period by the driving section is set so that a pair of the instruction data, not adjacent to each other in terms of order of being supplied to the data line, is included in pairs of the instruction data adjacent to each other in order of lighter to heavier weight.

In this arrangement, since a pair of the instruction data not adjacent to each other in terms of order of being supplied to the data line is included in pairs of the instruction data adjacent to each other in order of lighter to heavier weight, it becomes easier to adjust these instruction data when the weights of the instruction data are adjusted so that each of the instruction data corresponding to a different scanning line has a different timing (selection time) for being supplied to the data line. Accordingly the timings for selecting the scanning lines can be set more flexibly, thus providing an effect such that the range of the electro-optic device, capable of setting each stage of outputs in the frame period to be a desirable value, can further be enlarged.

As described, in addition to the foregoing arrangement, the driving device for driving an electro-optic device according to the present invention has such an arrangement that the weights of the respective instruction data to be supplied in the one frame period can be specified by the instruction data and are set so that a difference in the level between adjacent outputs in the one frame period is a predetermined fixed value, when the outputs in the one frame period respectively having different levels from each other are aligned in order of lower to higher in the level.

Accordingly, gradation level can have a linear characteristic with respect to the order of the output gradation level when the levels of the outputs in the frame period are aligned in order of smaller to greater level. As a result, since the electro-optic elements are supplied with a combination of the instruction data for outputting the outputs in the frame period which have order corresponding to the inputted data, it is possible to obtain a linear characteristic of the outputs in the frame period, thus realizing an electro-optic device having a linear characteristic.

As described, a display device according to the present invention has an electro-optic device including electro-optic elements capable of R-stage output (R is an integer not less than 2) provided for each combination of a plurality of scanning lines and at least one data line; and a driving device for driving the electro-optic device including a driving section for supplying gradation data of the respective electro-optic elements as the instruction data.

Here, in a display device, the required number of scanning lines changes according to the target resolution, and therefore respective display devices includes different numbers of scanning lines in their configurations. Further, the number of gradations displayable over one frame period tends to be set to a relatively large value, such as 256 gradation for red color, in response to the recent demand for multi-gradation display. Accordingly, even when the number B of outputs in a frame period is set to a smaller value than $R^A$ so that the respective outputs in a frame period become their target values at respective gradations (at respective stages), degradation of the displayed image due to the decrease of the number of gradations seldom occurs. On this account, it is possible to obtain a desirable value in the respective levels of the outputs in the frame period with respect to display devices in a wider range of the number of scanning lines.

As described, in addition to the foregoing arrangement, the display device according to the present invention has such an arrangement that at least one of the instruction data to be supplied to the electro-optic element in the one frame period is set to 0 in the weight, and an output period corresponding to the instruction data set to 0 in the weight is set to be not less than ¼ of the one frame period.

In this arrangement, an output period corresponding to the instruction data having the weight of 0 is adjusted to be not less than ¼ of the one frame period. Thus, it is possible to prevent such a phenomenon that: when the viewer's eye follow a moving image displayed by time divisional manner, the emitting period of the electro-optic elements corresponding to the respective instruction data (gradation data) are overlapped with each other, and this becomes visible as a dynamic false contour.

As described, in addition to the foregoing arrangement, the display device according to the present invention has such an arrangement that the driving section supplies one of different plural combinations of the instruction data with respect to the electro-optic elements whose outputs are identical with each other in the one frame period in the same frame period, and at least one of the electro-optic elements are supplied with a combination of the instruction data, which differs from the other combinations.

In this arrangement, the electro-optic elements identical in terms of the outputs in the one frame period in the same frame period include the electro-optic elements respectively supplied with different combinations of the instruction data. Thus, it is possible to prevent the foregoing dynamic false contour, which occurs when the viewer's eye follow a moving image.

As described, the display device according to the present invention of matrix-type has such an arrangement that: when B-gradation display is carried out by using electro-optic elements capable of R-gradation display, the weight ratio of the bit data is adjusted to be $R^0:R^1:\ldots R^m-n:\ldots$, such as 1:2:4:7: . . . (i.e., $2^0:2^1:2^2:2^3-1:\ldots$); namely, this ratio is adjusted to change the foregoing relation by adjusting the weight of bit at or after the third bit (for example, this operation is given by P×R>Q, where P expresses the weight ratio of the third bit, and Q expresses the weight ratio of the fourth bit).

Therefore, even when the number of display gradations are decreased, the weight ratio of the bits at or lower than the third bit can be strictly maintained, thus obtaining timings for time division gradation scanning so that the data transfer timings of the respective scanning line are not overlapped with each other, without significantly changing the actually-recognized image.

Furthermore, in an active matrix display device using such as TN liquid crystal or an organic EL as the electro-optic elements, it is possible to realize relatively accurate time division gradation display with the described desirable weight ratio of the bits, without using such as an initialization TFT, a selection line thereof, and a line for initialization data.

As described, the display device according to the present invention has such an arrangement that at least one of the A instruction data is set to 0 in the weight.

Therefore, since the occupied time in the unit time is determined by including at least one bit data for initialization scanning, it is possible to deal with an arbitrary number of scanning lines without using the described initialization TFT etc., even in an active matrix display device using such as TN liquid crystal or an organic EL as the electro-optic elements.

Furthermore, as described, the display device according to the present invention has such an arrangement that the most significant and the second most significant bit data are provided respectively at a beginning and at an end of a same frame period of the respective electro-optic elements.

Therefore, by adjusting the weights of these bit data, it is possible to obtain more flexible selecting timings. On this account, it becomes possible to freely set the number of scanning lines for one control group, up to a certain extent, thereby ensuring to carry out time division gradation display in compliance with the number of scanning lines of the display panel. Further, when adjusting the weight of the most significant bit so as to be not more than about 1.5 times of that of the second most significant bit, it is possible to suppress the dynamic false contour, which occurs when the viewer's eyes follow a moving image.

As described, the display device according to the present invention has such an arrangement that: in case where the electro-optic elements adjacent to each other display a same gradation in a same frame period, the electro-optic elements respectively light in accordance with different bit patterns.

Thus, it is possible to suppress the dynamic false contour, which occurs when the viewer's eyes follow a moving image displayed by the time division gradation display. Further, the patterns allotted to the respective electro-optic elements are changed and set in each frame period, thus more effectively suppressing the dynamic false contour.

As described, a driving method for driving an electro-optic device according to the present invention includes the step of: driving the electro-optic device by selecting the scanning lines so that each of the instruction data B1 through Ba appears once in A instruction data to be sequentially supplied to the data line, and the outputs in one frame period performed as an output of the electro-optic elements capable of R-stage output (R is an integer not less than 2) over the one frame period is controlled so that the instruction data B1 through Ba are supplied A times (A is an integer not less than 2) in the one frame period for each electro-optic element, in an output period before a next instruction data is supplied, to the electro-optic elements corresponding to the scanning line currently selected, via the data line corresponding to the electro-optic element. This arrangement allows the driving device to realize B-stage output in one frame period performed as output operation of the electro-optic elements. The driving method is also arranged so that the weight of each bit data is adjusted to satisfy $R^A>B$.

The foregoing driving device for driving an electro-optic device adopts this driving method, and therefore, in comparison with the arrangement of setting the weight of each instruction data so as to realize the relation of $B=R^A$, this arrangement can increase the number of scanning lines capable of setting each gradation level to be a target value. As a result, the range of the electro-optic device in which the target gradation can be set with respect to each stage output can further be enlarged over one frame period.

As described, the driving method of the display device of matrix-type according to the present invention includes the step of: (a) realizing B-gradation display by using electro-optic elements capable of R-gradation display wherein A bit data respectively correspond to different bit data, and satisfy a relation of $R^0:R^1:\ldots R^m-n:\ldots$ (m being an integer not less than 2, and n being an integer not less than 1), in the step (a).

Driving a display device in accordance with this method provides the foregoing display device; thus, the foregoing effect of enlarging the range of the display device for realizing relatively accurate time division gradation display with the described desirable weight ratio of the bits may also be ensured in this display device, as with the foregoing display device.

As described, a weight determination method according to the present invention is a weight determination method in a driving device for driving an electro-optic device having such an arrangement that the scanning lines are selected so that each of the instruction data B1 through Ba appears once in the A instruction data to be sequentially supplied to the data line, and the outputs in one frame period performed as an output of the electro-optic element capable of R-stage output (R is an integer not less than 2) over the one frame period is controlled by supplying the instruction data B1 through Ba respectively A times (A is an integer not less than 2) in the one frame period for each electro-optic element, in an output period before a next instruction data is supplied, to the electro-optic elements corresponding to the scanning line currently selected, via the data line corresponding to the electro-optic element; and the method comprising the steps of: (a) carrying out initialization by setting weights indicating respective sizes of the instruction data contributing to the one frame period so that a given bit data has an weight of R times of a weight of a immediately preceding bit data, when the instruction data are aligned in order of smaller to greater weight; and (b) providing a predetermined selection time as a selection time for starting the output period of a first instruction data in order of smaller to greater weight; (c) determining a length of the output period appropriate for the instruction data according to the weight of the instruction data, and providing the selection time for starting the output period of a next instruction data by using the selection time at a time when the output period is terminated, the step (c) being repeated until all of the instruction data are provided with the selection time; (d) judging whether or not the selection time thus provided to the next instruction data is identical to the selection time which has been provided before; and when it is judged that the selection time is the same as the selection time which has been provided before in the step (d), (e) adjusting the instruction data so that each of the instruction data, including the instruction data which have already been provided with the selection time and the instruction data which is to be provided with the selection time next, has a different selection time, by reducing the weight of the instruction data whose length of the output period has been determined in or before the step (c).

In the foregoing method, when it is judged that the selection time is the same as the one provided before, adjusting (1) the selection time for the next bit data, which is obtained by reducing the weight of the bit data whose length of the output period has been determined in or before the step (c), and (2) the selection times which have ever been provided, so that the selection times are not overlapped with each other.

As a result, regardless of the number of the scanning lines, the display gradation number B over the one frame period can be set to be smaller than $R^A$, while adjusting that the timings (selection times) at which the respective bit data corresponding to different scanning lines are sent to the data lines are not overlapped each other, and also, when the gradation levels are aligned in order of lower to higher, the difference between the gradation levels adjacent to each other in the unit time is always a fixed value. Thus, by adopting the foregoing determination method and determining the weight of data, which is used when the driving device for driving an electro-optic device carries out driving of the electro-optic device, it is possible to realize a driving device for driving an electro-optic device capable of setting each stage of outputs in the frame period to be a target value, and the electro-optic device can be extensively selected from a wider range.

As described, in addition to the foregoing arrangement, the weight determination method according to the present invention has such an arrangement that the step (e) includes a step for changing order of the instruction data in a manner such that; before reducing the weight of the instruction data having a lighter weight than the instruction data subjected to providing of the selection time, one of the instruction data which have not been provided with the selection time is allotted as the next instruction data, which is to be provided with the selection time next, so that each of the instruction data, including the instruction data which have already been provided with the selection time and the instruction data which is to be provided with the selection time next, has a different selection time.

In this arrangement, the adjustment of the weight is carried out by changing the order of the instruction data for providing the selection times before reducing the weight of the data so that each bit data has a different selection time. Consequently, the number of outputs in a frame period can be increased, compared to the case of fixing the order of providing the selection time.

A driving device for driving an electro-optic device according to the present invention is arranged in order to solve the foregoing problems in a driving device for driving an electro-optic device including electro-optic elements capable of R-stage output (R is an integer not less than 2), the electro-optic elements being provided for each combination of a plurality of scanning lines and at least one data line, including: a driving section for supplying instruction data, which instructs outputs in an output period before a next instruction data is supplied, to the electro-optic elements corresponding to the scanning line currently selected among the plurality of scanning lines sequentially selected, the driving section supplying the instruction data to the electro-optic element via the data line corresponding to the electro-optic element, wherein: the driving section supplying A instruction data A times (A being an integer not less than 2) in the one frame period for each electro-optic element so as to control outputs in one frame period performed as an output operation of the electro-optic elements over the one frame period, and selecting the scanning lines so that each of the A instruction data sequentially supplied to the data line appears once, and weights indicating respective sizes of the instruction data supplied in the outputs in the one frame period are set to satisfy $R^A>B$ where a number of levels of the outputs in the one frame period specified by a combination of A instruction data supplied to the electro-optic elements in the one frame period is B.

In the foregoing arrangement, the driving section selects the scanning lines in the foregoing manner, and supplies the instruction data to the electro-optic elements via the data line so as to change the output state of the electro-optic elements A times in one frame period. In this manner, the value of level of the output in the frame period can be found by adding the respective levels of outputs of the electro-optic elements in each output period with their weights added, which vary depending on lengths of the respective output periods. Therefore, even though the electro-optic elements are only capable of R-stage (R-gradation) output, output of the electro-optic elements may be controlled to be B-stage (B-gradation) output, which is greater than the R-stage output, in accordance with the combinations of the instruction data.

Further, the output in the frame period is controlled according to the stage of output of the electro-optic elements in each output period and the weight varying depending on the length of the output period; therefore, the output in the frame period can be controlled with higher accuracy than the case of B-stage control of the electro optic elements.

Here, in the driving, while a scanning line is selected, the instruction data cannot be supplied to the electro-optic elements corresponding to other scanning lines. Accordingly, the arrangements provides the relation of $B=R^A$. Further, when the weight of each instruction data is adjusted so as to provide a target value with respect to each of the output level in the frame period, the number of scanning lines of the electro-optic device is limited, which causes to limit the type of electro-optic device drivable in the arrangement.

In contrast, in the driving device for an electro-optic device having the foregoing arrangement, the weights of the instruction data are adjusted and set so as to satisfy the relation of $R^A>B$. Therefore, in comparison with the arrangement of setting the weight of each instruction data so as to realize the relation of $B=R^A$, this arrangement can increase the number of scanning lines capable of setting each gradation level to be a target value. As a result, the range of the electro-optic device in which the target gradation can be set with respect to each stage output can further be enlarged over one frame period.

Figure 17:
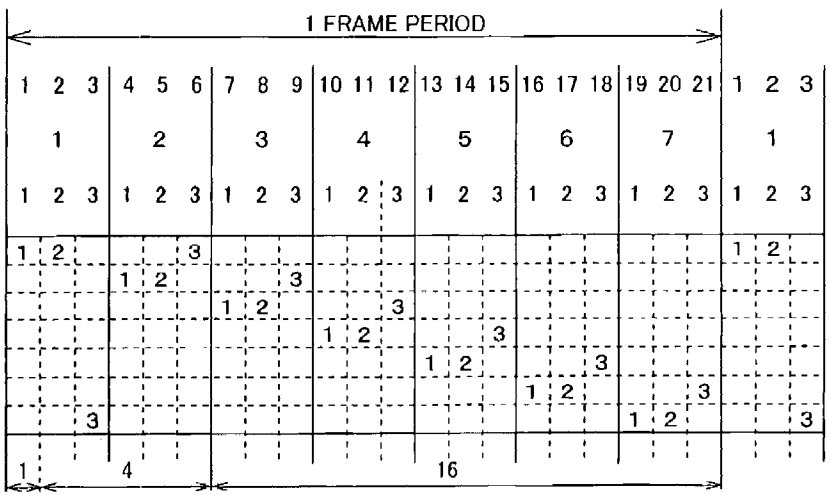
FIG. 17 CONVENTIONAL ART
FIG. 17 is a timing diagram showing a scanning method of time division gradation using another conventional technique.
Figure 18:
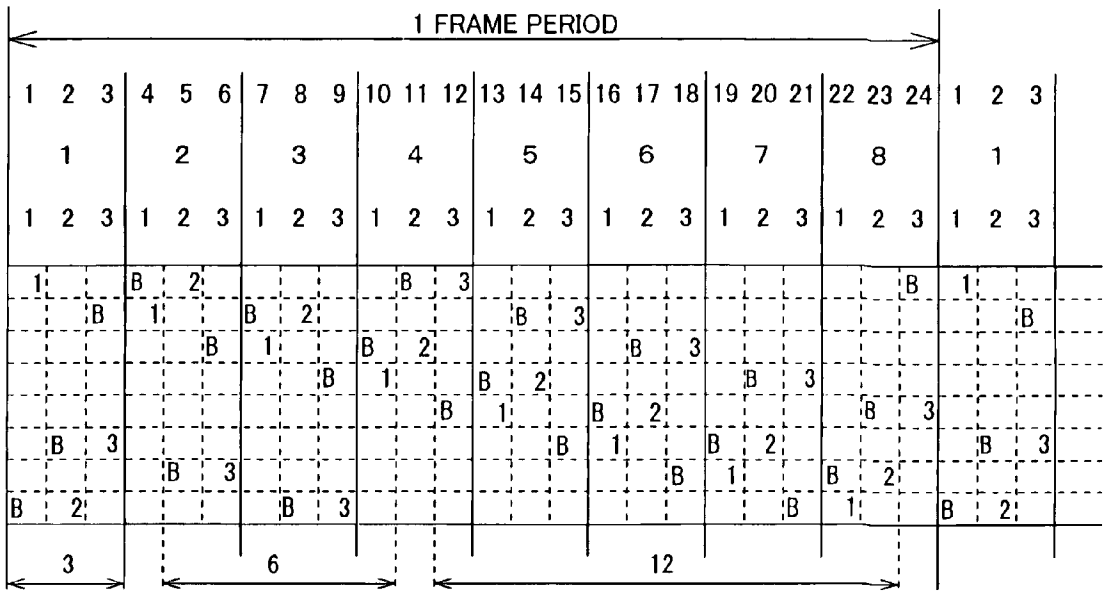
FIG. 18 CONVENTIONAL ART
FIG. 18 is a timing diagram showing another scanning method of time division gradation using the conventional technique of FIG. 17.

For example, FIG. 17 shows the arrangement having the electro-optic elements capable of 4-gradation display, and respectively supplied with the gradation data as the instruction data three times in each frame period. In this arrangement of the patent document 2, the respective weights are set to be 1:4:16 so that the differences between the 64 gradations all become the same value (all increased by 1). Therefore, Example 1 of the patent document 2 (see FIG. 1 of the patent document 2) adopts a display device, which is arranged so as to set the value found by: (number of scanning lines)×(number of instruction of gradation data)=7×3=21 to be an integral multiple of the summation of the weight ratio (1+4+16=21). Also, Example 2 and further examples of the patent document 2 (see FIG. 2 and later figures of the patent document 2) use a display device of a particular arrangement (such as an arrangement for carrying out individual initialization scanning, and an initialization line apart from the data line or the scanning lines). As a result, the type of the display device, capable of setting each gradation to be target value, is limited. Note that, in the arrangement of the patent document 1, though the arrangement intends to realize 16 gradations display by setting the respective weights to be 1:2:4:8, the actual weight ratio comes out as 5:9:17:29, and each level of the 16 gradations fails to be a target value (a value which is a linear with respect to the input bit). Thus, it includes an error.

On the other hand, in the present invention, the weights of the gradation data are adjusted and set, such as to be 1:2:4:7:15:25, so that each of the instruction data corresponding to the scanning line is supplied to the data line at a different timing (selection time), and each level of 54 gradations has the linearity as a target value. In this arrangement, the gradation number B is decreased to 54 gradations from $R^A$=64 gradations; however, the decreasing rate is reduced as $R^A$ increases. In the foregoing ratio example, the decreasing rate is 16%; however, when B is set to 250 with respect to $R^A$ of 256 so as to realize the foregoing different timing for supplying the instruction data, the decreasing ratio is only 2.3%. Further, unlike the arrangement of the patent document 1, this arrangement does not cause the error in the value, since the gradations are all set to target values in the displayable gradations. Consequently, even though the output result (for example, a displayed image) is not different so much from the patent document 2, this arrangement can be used for a display device including scanning lines whose number is other than multiples of 7, unlike the patent document 2. Further, this arrangement requires neither an initialization line apart from the data line, nor a circuit for concurrently performing (a) selection of scanning lines for reading the gradation data supplied to the data line and (b) selection of other scanning lines for carrying out initialization. Thus, it is possible to extend the range of the electro-optic device, capable of setting each stage of outputs in the frame period to be a target value. Note that, in case of having a different number of scanning lines, the gradation number B may be reduced from $R^A$ according to the number of the scanning lines.

Further, in addition to the foregoing arrangement, the weights indicating the respective sizes of the instruction data supplied in the one frame period may be set so that a pair of the instruction data whose weight ratio satisfies G: (G×R−n) is included among pairs of the instruction data adjacent to each other when the instruction data are aligned in order of lighter to heavier weight, where G is an integer not less than 1 and n is an integer not less than 1 and not more than G×(R−1).

In this arrangement, as described, the scanning lines are selected so as to supply the instruction data to the electro-optic elements via the data line. Besides, in this arrangement, a pair of the instruction data whose weight ratio satisfies G: (G×R−n) is included. Consequently, the value found by: (number of scanning lines)×(number of bits/summation of the weights of all instruction data) becomes an integer.

Also in this arrangement, the weight of each bit data is adjusted to satisfy $R^A>B$, thus providing an effect such that the range of the electro-optic device in which the target gradation can be set with respect to each stage output can further be enlarged over one frame period.

Further, in addition to the foregoing arrangement of having a pair of the instruction data adjacent to each other whose weight ratio satisfies G: G×R−n, at least one of the instruction data supplied to the electro-optic elements in the one frame period may be set to 0 in the weight.

In this arrangement, the foregoing inequality $R^A>B$ is satisfied since at least one of the instruction data is set to 0 in the weight. As a result, the range of the electro-optic device in which the target gradation can be set with respect to each stage output can further be enlarged over one frame period.

Further, since one of the instruction data is set to 0 in the weight, it is not necessary to carry our initialization scanning apart from the scanning operation for supplying the instruction data to the electro-optic elements. Further, by having the weight of 0, change of the length of the output period corresponding to the instruction data having the weight of 0 does not affect the outputs in the frame period. Accordingly it is possible to adjust the length of the output period corresponding to the instruction data having the weight of 0 so that the timings (selection times) of the respective instruction data corresponding to a different scanning line for being supplied to the data line are not overlapped with each other, without changing the value of the respective stages of the outputs in the frame period, while providing an length of the output period appropriate for the number of scanning lines. As a result, the range of the electro-optic device, capable of setting each stage of outputs in the frame period to be a desirable value, can be enlarged.

Further, in addition to the foregoing arrangements, order of the A instruction data supplied to the data line in the one frame period by the driving section may be adjusted so that order of the A instruction data to be supplied to the data line in the one frame period by the driving section is set so that a pair of the instruction data, not adjacent to each other in terms of order of being supplied to the data line, is included in pairs of the instruction data adjacent to each other in order of lighter to heavier weight.

In this arrangement, since a pair of the instruction data not adjacent to each other in terms of order of being supplied to the data line is included in pairs of the instruction data adjacent to each other in order of lighter to heavier weight, it becomes easier to adjust these instruction data when the weights of the instruction data are adjusted so that each of the instruction data corresponding to a different scanning line has a different timing (selection time) for being supplied to the data line. Accordingly the timings for selecting the scanning lines can be set more flexibly, thus providing an effect such that the range of the electro-optic device, capable of setting each stage of outputs in the frame period to be a desirable value, can further be enlarged.

Further, the foregoing desirable value may be an arbitrary value; however, in addition to the foregoing arrangements, the weights of the respective instruction data to be supplied in the one frame period can be specified by the instruction data and may be set so that a difference in the level between adjacent outputs in the one frame period is a predetermined fixed value, when the outputs in the one frame-period respectively having different levels from each other are aligned in order of lower to higher in the level.

In this arrangement, when the outputs in the one frame period respectively having different levels from each other are aligned in order of lower to higher in the level, the weights of the instruction data are determined so that a difference in the level between adjacent outputs in the one frame period becomes a predetermined fixed value.

For example, when the outputs are aligned in order of lower to higher level, and assuming that the weight of p-th instruction data is expressed as W(p), the respective weights are adjusted so that $\beta/K$ becomes an integer not more than 1 (including negative values), where $\beta$ expresses the value found by subtracting the summation a of all of the weights W(p) (from W(1) to W(p−1)) from W(p), and K expresses the least significant weight other than 0. In this manner, the level difference between the outputs in the frame period becomes a fixed value.

Accordingly, the levels of the outputs in the frame period can have a linear characteristic with respect to the order of the output gradation level when the levels of the outputs in the frame period are aligned in order of smaller to greater level. As a result, since the electro-optic elements are supplied with a combination of the instruction data for outputting the outputs in the frame period which have order corresponding to the inputted data, it is possible to obtain a linear characteristic of the outputs in the frame period, thus realizing an electro-optic device having a linear characteristic.

Incidentally, each driving device for driving an electro-optic device described above may be an arbitrary driving device for driving an electro-optic device, as long as it includes the described configuration. However, as one preferable example, the driving section may supply gradation data as the instruction data to display elements as the electro-optic elements.

Specifically, a display device according to the present invention has an electro-optic device including electro-optic elements capable of R-stage output (R is an integer not less than 2) provided for each combination of a plurality of scanning lines and at least one data line; and a driving device for driving the electro-optic device including a driving section for supplying gradation data of the respective electro-optic elements as the instruction data.

Here, in a display device, the required number of scanning lines changes according to the desired resolution, and therefore respective display devices include different numbers of scanning lines in their configurations. Further, the number of gradations displayable over one frame period tends to be set to a relatively large value, such as 256 gradation for red color in response to the recent demand for multi-gradation display. Accordingly, even when the number B of outputs in a frame period is set to a smaller value than $R^A$ so that the respective outputs in a frame period become their target values at respective gradations (at respective stages), degradation of the displayed image due to the decrease of the number of gradations seldom occurs. On this account, it is possible to obtain a desirable value in the respective levels of the outputs in the frame period with respect to display devices in a wider range of the number of scanning lines.

Further, in addition to the foregoing arrangement, at least one of the instruction data supplied to the electro-optic element in the one frame period may be set to 0 in the weight, and an output period corresponding to the instruction data set to 0 in the weight may be adjusted to be not less than ¼ of the one frame period.

In this arrangement, an output period corresponding to the instruction data having the weight of 0 is adjusted to be not less than ¼ of the one frame period. Thus, it is possible to prevent such a phenomenon that: when the viewer's eye follow a moving image displayed by time divisional manner, the emitting period of the electro-optic elements corresponding to the respective instruction data (gradation data) are overlapped with each other, and this becomes visible as a dynamic false contour.

Particularly, in the case of using organic EL as the electro-optic element, its degradation property does not significantly change even when the luminance becomes approximately twice so as to make up the reduction of the emitting period, which is cut down to approximately ½, provided that the average luminance per unit area stays the same. Therefore, when using the organic EL as the electro-optic elements, by adopting the foregoing arrangement, it is possible to extend the life of the display device and to suppress the occurrence of the dynamic false contour.

Note that, this case only requires adjustment of the length of the output period of the gradation data having the weight of 0, and therefore the length of the output period may be freely set to some extent. Further, this arrangement requires neither the initialization line apart from the data line, nor the circuit for concurrently performing (a) selection of scanning lines for reading the gradation data supplied to the data line and (b) selection of other scanning lines for carrying out initialization.

Further, in addition to the foregoing arrangement, the driving section may supply one of different plural combinations of the instruction data with respect to the electro-optic elements whose outputs are identical with each other in the one frame period in the same frame period, and at least one of the electro-optic elements may be supplied with a combination of the instruction data, which differs from the other combinations.

In this arrangement, the electro-optic elements identical in terms of the outputs in the one frame period in the same frame period includes the electro-optic elements respectively supplied with different combinations of the instruction data. Thus, it is possible to prevent the foregoing dynamic false contour, which occurs when the viewer's eye follow a moving image. Note that, if the patterns allotted to the respective electro-optic elements are changed and set in each frame period, it is possible to more effectively suppress the dynamic false contour.

Further, a display device according to the present invention is a display device of matrix-type including electro-optic elements capable of R-gradation display (R is an integer not less than 2) aligned in a matrix manner, and the display device is driven by setting the electro-optic elements to have A times (A being an integer not less than 4) of display states in one frame period so that the electro-optic elements are capable of B-gradation (B is an integer satisfying B>R) display. The display device is arranged so that the weight ratio of the A bit data is not made by increasing multiples of R but the reducing increase ratio of the weight of gradation from multiplier of R, such as: $R^0:R^1: \ldots R^m-n: \ldots$ (m is an integer not less than 2, and n is an integer not less than 1), so that the weight ratio of the all bit satisfies the equation of, (number of scanning lines)×(number of bits/summation of the weights of all instruction data)=an integer where the weight of the least significant bit is 1.

In the conventional technique, when B-gradation display is realized by using electro-optic elements capable of R-gradation display; for example, when A bit data are sequentially aligned in order of lighter to heavier weight, such as 1:2:4:8: . . . (i.e., 20:21:22:23: . . . ), these bit data are all factorial numbers of R ($R^0:R^1:R^2:R^3: \ldots$) for the purpose of expressing a large number of gradations with as little number of bits as possible. However, with the foregoing arrangement, the display device according to the present invention of matrix-type has the weight ratio of: $R^0:R^1: \ldots R^m-n: \ldots$, which is adjusted to change the foregoing relation by adjusting the weight of bit at or after the third bit (for example, this operation is given by $P \times R > Q$ and $P \times R \neq Q$, where P expresses the weight ratio of the third bit, and Q expresses the weight ratio of the fourth bit).

Specifically, in the case of using the A bit data, it is assumed that a time for selecting one scanning line is expressed as a selection time, and A selection times make up a unit time for control. Further, the first selection time in a unit time is expressed as a 0th occupied time, and the second one is expressed as a first occupied time. Namely, a A-th selection time is a (A−1)-th occupied time. The occupied time is used as a time slot for selecting the respective scanning lines. Further, the control based on the unit time is repeated for the provided number of scanning lines so as to constitute one frame period.

Secondly, as to each of the pixels, unlike the conventional technique in which the A bit data written to one given pixel are provided with sequential occupied times of $0 \rightarrow 1 \rightarrow 2 \ldots \rightarrow (A-1)$ in order of lighter to heavier weight; however, in the present invention, the number of the occupied times disorderly ascends and descends, such as $0 \rightarrow 1 \rightarrow 3 \rightarrow 4 \rightarrow 2 \rightarrow 5$, as shown in FIG. 9. Further, each bit data is determined for its occupied time in the unit time so that the bit data can have the selection times accurately corresponding to the weight, especially for the lower bit data (first to third lowest bits), and also the occupied times of respective bit data are not overlapped with each other. Therefore, the weight ratio of the A bit data is varied to be $R^0:R^1: \ldots R^m-n: \ldots$ (m is an integer not less than 2, and n is an integer not less than 1) from the default values of $R^0:R^1:R^2:R^3: \ldots$.

As described, in the driving method shown in FIG. 9, for example, the weight ratio of the bit data is adjusted to be 1:2:4:7:15 where the weight ratio between the bits is 2 (R=2), unlike the conventional ratio of 1:2:4:8:16:32. In this arrangement, the number of display gradations is reduced from 64 gradations to 54 gradations, which is reduced by about 16%; however, the weight ratio of the bits at or lower than the third bit can be strictly maintained, thus obtaining timings for time division gradation scanning so that each scanning line has a different data transfer timing, without significantly changing the actually-recognized image.

Furthermore, in an active matrix display device using such as TN liquid crystal or an organic EL as the electro-optic elements, it is possible to realize relatively accurate time division gradation display with the described desirable weight ratio of the bits, without using such as an initialization TFT, a selection line thereof, and a line for initialization data.

Thus, it is possible to provide a display device with the wider range of the number of scanning lines or the arrangement of the electro-optic device in which the target gradation can be set with respect to each stage output can further be enlarged over one frame period.

Further, a display device driven by time divisional gradation driving method, with the condition of "weight ratio of data bit=ratio of display period of displayed bit" can be realized without using an initialization TFT (such as the TFT 2 shown in FIGS. 19 and 20), a selection line thereof, and a line for initialization data, by a method different from the method disclosed in the patent document 2.

As described, in addition to the foregoing arrangement, at least one of the A instruction data may be set to 0 in the weight.

In the foregoing arrangement, since the occupied time included in the unit time is determined by including at least one bit data for initialization scanning, it is possible to provide an arrangement capable of dealing with an arbitrary number of scanning lines without using the described initialization TFT etc., even in an active matrix display device using such as TN liquid crystal or an organic EL as the electro-optic elements. For example, in the driving method shown in FIG. 5, the weight ratio of the bit data is adjusted to be 1:2:4:7:0 where the weight ratio between the bits is 2 (R=2), unlike the conventional ratio of 1:2:4:8. In this arrangement, the number of display gradations is reduced by 1, and bit data for initialization scanning is required; however, only one initialization is required in one frame period to deal with an arbitrary number of scanning lines. Thus, time divisional gradation display can be carried out without using such as an initialization TFT.

On this account it is possible to realize a display device capable of time divisional gradation driving which can deal with an arbitrary number of scanning lines without performing initialization scanning apart from the scanning for writing display bit data.

Furthermore, as described, the display device according to the present invention has such an arrangement that the most significant and the second most significant bit data are provided respectively at a beginning and at an end of a same frame period of the electro-optic element.

With this arrangement, by providing the most significant and the second most significant bit data in such a manner and also adjusting their weights, it is possible to obtain more flexible selecting timings. On this account, it becomes possible to freely set the number of scanning lines for one control group, up to a certain extent, thereby ensuring to carry out time division gradation display in compliance with the number of scanning lines of the display panel. Further, when adjusting the weight of the most significant bit is adjusted to be not more than about 1.5 times of that of the second most significant bit, it is possible to suppress the dynamic false contour, which occurs when the viewer's eyes follow a moving image.

Further, the display device according to the present invention has such an arrangement that: in case where the electro-optic elements adjacent to each other display a same gradation in a same frame period, the electro-optic elements respectively light in accordance with different bit patterns.

With this arrangement, it is possible to suppress the dynamic false contour, which occurs when the viewer's eyes follow a moving image displayed by the time division gradation display. Further, the patterns allotted to the respective electro-optic elements are changed and set in each frame period, thus more effectively suppressing the dynamic false contour.

A driving method for driving an electro-optic device according to the present invention is a driving method for an electro-optic device including electro-optic elements capable of R-stage output (R is an integer not less than 2) provided for each combination of a plurality of scanning lines and at least one data line, which includes the step of: (a) driving the electro-optic device by supplying instruction data, which instructs outputs in an output period before a next instruction data is supplied, to the electro-optic elements corresponding to the scanning line currently selected among the plurality of scanning lines sequentially selected, via the data line corresponding to the electro-optic element, wherein the outputs in one frame period performed as output operation of the electro-optic elements over the one frame period are controlled by supplying instruction data B1 through Ba respectively A times (A is an integer not less than 2) in the one frame period for each electro-optic element, in the step (a), the scanning lines are selected so that each of the instruction data B1 through Ba appears once in A instruction data to be sequentially supplied to the data line, in the step (a), and weights indicating respective sizes of the instruction data contributing to the outputs in the one frame period are set to satisfy $R^A>B$ where a number of levels of the outputs in the one frame period specified by a combination of the A instruction data to be supplied to the electro-optic elements in the one frame period is B.

The foregoing driving device for driving an electro-optic device adopts this driving method, and therefore, in comparison with the arrangement of setting the weight of each instruction data so as to realize the relation of $B=R^A$, this arrangement can increase the number of scanning lines capable of setting each gradation level to be a target value. As a result, the range of the electro-optic device in which the target gradation can be set with respect to each stage output can further be enlarged over one frame period.

Further, in order to solve the foregoing conventional problems, a driving method for driving a display device according to the present invention is a driving method for driving a display device of matrix-type including electro-optic elements capable of R-gradation display (R being an integer not less than 2) aligned in a matrix manner, which includes the step of: (a) driving the display device by setting the electro-optic elements to have A times (A being an integer not less than 4) of display states in one frame period so that the electro-optic elements are capable of B-gradation display (B being an integer satisfying B>R), wherein A bit data respectively correspond to different bit data, and satisfy a relation of $R^0:R^1:\ldots R^m-n:\ldots$ (m being an integer not less than 2, and n being an integer not less than 1), in the step (a).

Driving a display device with this method provides the foregoing display device; thus, the foregoing effect of enlarging the range of the display device for realizing relatively accurate time division gradation display with the described desirable weight ratio of the bits may also be ensured in this display device, as with the foregoing display device.

Further, on this account, it is possible to realize a time divisional gradation driving method, with the condition of "weight ratio of data bit=ratio of display period of displayed bit", without using the described initialization TFT (such as the TFT 2 of FIGS. 19 and 20), by a method different from the method disclosed in the patent document 2.

Further, in addition to the foregoing arrangement, since at least one of the A instruction data is set to 0 in the weight, it is possible to realize a display device of time divisional gradation driving with an arbitrary number of scanning lines without performing initialization scanning apart from the scanning for writing display bit data.

Further, a weight determination method in a driving device for driving an electro-optic device according to the present invention is a weight determination method in a driving device for driving an electro-optic device including electro-optic elements capable of R-stage output (R is an integer not less than 2) provided for each combination of a plurality of scanning lines and at least one data line. The driving device includes a driving section for supplying instruction data, which instructs outputs in an output period before a next instruction data is supplied, to the electro-optic elements corresponding to the scanning line currently selected among the plurality of scanning lines sequentially selected. The driving section supplies the instruction data to the electro-optic element via the data line corresponding to the electro-optic element. The driving section controls outputs in one frame period performed as output of the electro-optic elements over the one frame period by supplying instruction data B1 through Ba respectively A times (A is an integer not less than 2) in the one frame period for each electro-optic element, and the outputs in one frame period is controlled by supplying the instruction data B1 through Ba respectively A times (A is an integer not less than 2) in the one frame period for each electro-optic element; and the method comprising the steps of: (a) carrying out initialization by setting weights indicating respective sizes of the instruction data contributing to the one frame period so that a given bit data has an weight of R times of a weight of a immediately preceding bit data, when the instruction data are aligned in order of smaller to greater weight; and (b) providing a predetermined selection time as a selection time for starting the output period of a first instruction data in order of smaller to greater weight; (c) determining a length of the output period appropriate for the instruction data according to the weight of the instruction data, and providing the selection time for starting the output period of a next instruction data by using the selection time at a time when the output period is terminated, the step (c) being repeated until all of the instruction data are provided with the selection time; (d) judging whether or not the selection time thus provided to the next instruction data is identical to the selection time which has been provided before; and when it is judged that the selection time is the same as the selection time which has been provided before in the step (d), (e) adjusting the instruction data so that each of the instruction data, including the instruction data which have already been provided with the selection time and the instruction data which is to be provided with the selection time next, has a different selection time, by reducing the weight of the instruction data whose length of the output period has been determined in or before the step (c).

In the foregoing method, when it is judged that the selection time is the same as the one provided before, adjusting (1) the selection time for the next bit data, which is obtained by reducing the weight of the bit data whose length of the output period has been determined in or before the step (c), and (2) the selection times which have ever been provided, so that the selection times are not overlapped with each other.

As a result, regardless of the number of the scanning lines, the display gradation number B over the one frame period can be set to be smaller than $R^A$, while adjusting that the timings (selection times) at which the respective bit data corresponding to different scanning lines are sent to the data lines are not overlapped each other, and also, when the gradation levels are aligned in order of lower to higher, the difference between the gradation levels adjacent to each other in the unit time is always a fixed value.

Thus, by adopting the foregoing determination method for determining the weight of data, which is used when the driving device for driving an electro-optic device carries out driving of the electro-optic device, it is possible to obtain a desirable value in the respective levels of the outputs in the frame period with respect to display devices in a wider range of the number of scanning lines.

Further, in addition to the foregoing arrangement, the foregoing step (e) may include a step for changing order of the instruction data in a manner such that; before reducing the weight of the instruction data having a lighter weight than the instruction data subjected to providing of the selection time, one of the instruction data which have not been provided with the selection time is allotted as the next instruction data, which is to be provided with the selection time next, so that the all bit data, including the bit data which have been provided with the selection times and the bit data which is to be provided with the selection time next, are not overlapped with each other.

In this arrangement, the adjustment of the weight is carried out by changing the order of the instruction data for providing the selection times before reducing the weight of the data, so that each bit data has a different selection time. Consequently, the number of output in a frame period can be increased, compared to the case of fixing the order of providing the selection time.

Note that, this adjustment may also be carried out by replacing the instruction data which have already been provided with the selection time with one of the instruction data which have not been provided with the selection time, so that each of the instruction data, including the instruction data which have already been provided with the selection time and the instruction data which is to be provided with the selection time next, has a different selection time. In this arrangement, the adjustment of the weight is also carried out by changing the order of the instruction data for providing the selection times before reducing the weight of the data, so that the selection times of the respective bit data are not overlapped with each other. Consequently, the number of output in a frame period can be increased, compared to the case of fixing the order of providing the selection time.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A driving device for driving an electro-optic device including electro-optic elements capable of outputting R gradations of brightness (R being an integer not less than 2), the electro-optic elements being provided for each combination of a plurality of scanning lines and at least one data line, the driving device comprising:

a driving section for supplying instruction data to the electro-optic elements corresponding to the scanning line currently selected among the plurality of scanning lines sequentially selected, the driving section supplying the instruction data to the electro-optic elements via the data lines corresponding to the electro-optic elements, the instruction data for controlling outputs of the electro-optic elements for a period until subsequent instruction data is supplied, the driving section supplying instruction data A times (A being an integer not less than 2) in one frame period to each electro-optic element so as to control outputs thereof in the one frame period, each instruction data having a weight selected from A predetermined weights, such that the weight of at least one instruction data of the instruction data in each frame period is different from the weight of an immediately previously supplied instruction data and different from the weight of an immediately subsequently supplied instruction data, weights of the instruction data contributing to the outputs in the one frame period are set such that $R^A > B$ where B is a number of brightness levels displayable in the one frame period by a combination of the A weights of instruction data being supplied to the electro-optic elements in the one frame period, and each difference in brightness between adjacent brightness levels among the B brightness levels is the same.

2. The driving device for driving an electro-optic device as set forth in claim 1, wherein:

the weights of the respective instruction data to be supplied in the one frame period are set so that a pair of the instruction data whose weight ratio satisfies $G:(G \times R-n)$ is included among pairs of the instruction data adjacent to each other when the instruction data are aligned in order of lower to higher weight, where G is a weight of a first one of the pair of the instruction data and is an integer not less than 1 and n is an integer not less than 1 and not more than $G \times (R-1)$.

3. The driving device for driving an electro-optic device as set forth in claim 1, wherein:

at least one of the instruction data to be supplied to the electro-optic elements in the one frame period is set to 0 in the weight.

4. The driving device for driving an electro-optic device as set forth in claim 2, wherein:

at least one of the instruction data to be supplied to the electro-optic elements in the one frame period is set to 0 in the weight.

5. The driving device for driving an electro-optic device as set forth in claim 1, wherein:

order of the A instruction data to be supplied to the data line in the one frame period by the driving section is set so that a pair of the instruction data, not adjacent to each other in terms of order of being supplied to the data line, is included in pairs of the instruction data adjacent to each other in order of lower to higher weight.

6. The driving device for driving an electro-optic device as set forth in claim 1, wherein:

the weights of the respective instruction data to be supplied in the one frame period can be specified by the instruction data and are set so that a difference in the brightness level between adjacent outputs in the one frame period is a predetermined fixed value, when the outputs in the one frame period respectively having different levels from each other are aligned in order of lower to higher in the level.

7. A display device, comprising:

an electro-optic device including electro-optic elements capable of outputting R gradations of brightness (R being an integer not less than 2), the electro-optic elements being provided for each combination of a plurality of scanning lines and at least one data line; and a driving device for driving the electro-optic device including a driving section for supplying instruction data to the electro-optic elements corresponding to the scanning line currently selected among the plurality of scanning lines sequentially selected, the driving section supplying the instruction data to the electro-optic elements via the data lines corresponding to the electro-optic elements, the instruction data for controlling outputs of the electro-optic elements for a period until subsequent instruction data is supplied, the driving section (a) supplying instruction data P1 through PA (A being an integer not less than 2) in one frame period for each electro-optic element so as to control outputs thereof in the one frame period, (b) selecting the scanning lines so that each of the instruction data P1 through PA appears once in the instruction data to be sequentially supplied to the data line, (c) supplying gradation data of the electro-optic elements as the instruction data, and (d) supplying the instruction data such that at least one instruction data of the instruction data in each frame period is different from an immediately previously supplied instruction data and different from an immediately subsequently supplied instruction data, and weights of the instruction data contributing to the outputs in the one frame period being set to satisfy $R^A>B$ where B is a number of brightness levels displayable in the one frame period by a combination of A weights of instruction data being supplied to the electro-optic elements in the one frame period, wherein at least one of the instruction data to be supplied to the electro-optic element in the one frame period is set to 0 in the weight.

8. The display device as set forth in claim 7, wherein:

an output period corresponding to the instruction data set to 0 in the weight is set to be not less than ¼ of the one frame period.

9. The display device as set forth in claim 7, wherein:

the driving section supplies different instruction data over one frame period to a first electro-optic element and a second electro-optic element, and the first and second electro-optic elements have the same brightness.

10. A display device of matrix-type including electro-optic elements capable of outputting R gradations (R being an integer not less than 2) aligned in a matrix manner, each of the electro-optic elements having A (A being an integer not less than 4) display state time periods in one frame period such that the electro-optic elements are capable of B-levels of display output over one frame period (B being an integer satisfying B>R), and the B levels of display output are represented by A bits of data, the bits of the A bits of data satisfying a relation of $R^0:R^1:\ldots R^m-n:\ldots$ (m being an integer not less than 2, and n being an integer not less than 1), weights of the data contributing to the outputs in the one frame period are set such that $R^A>B$ where B is a number of brightness levels displayable in the one frame period by a combination of A weights of instruction data being supplied to the electro-optic elements in the one frame period, and each difference in brightness between adjacent brightness levels among the B brightness levels is the same.

11. A display device as set forth in claim 10, wherein at least one of the A bit data has a weight of 0.

12. A display device as set forth in claim 10, wherein:

first most significant and second most significant bit data are provided respectively at a beginning and at an end of a same frame period of the respective electro-optic elements.

13. A display device as set forth in claim 10, wherein:

in case where the electro-optic elements adjacent to each other display a same gradation in a same frame period, the electro-optic elements respectively light in accordance with different bit patterns.

14. A driving method for driving an electro-optic device including electro-optic elements capable of outputting R gradations of brightness (R being an integer not less than 2) provided for each combination of a plurality of scanning lines and at least one data line, the method comprising the step of:

(a) driving the electro-optic device by supplying instruction data to the electro-optic elements corresponding to the scanning line currently selected among the plurality of scanning lines sequentially selected, via the data lines corresponding to the electro-optic elements, the instruction data for controlling outputs of the electro-optic elements for a period until subsequent instruction data is supplied, wherein:

the outputs in one frame period are controlled by supplying instruction data, P1 through PA (A being an integer not less than 2), in the one frame period to each electro-optic element, in the step (a), the scanning lines are selected so that respective instruction data are applied to electro-optic elements corresponding to the selected scanning lines, in the step (a), and weights of the instruction data contributing to the outputs in the one frame period are set to satisfy $R^A>B$ where B is a number of brightness levels displayable in the one frame period by a combination of the A weights of instruction data being supplied to the electro-optic elements in the one frame period, each difference in brightness between adjacent brightness levels among the B brightness levels is the same, and the instruction data is supplied such that at least one instruction data of the instruction data in each frame period is different from an immediately previously supplied instruction data and different from an immediately subsequently supplied instruction data.

15. A driving method for driving a display device of matrix-type including electro-optic elements capable of outputting R gradations (R being an integer not less than 2) aligned in a matrix manner, the driving method comprising the step of:

(a) driving the display device by setting the electro-optic elements to have A (A being an integer not less than 4) display state time periods in one frame period so that the electro-optic elements are capable of B levels of display output over one frame period (B being an integer satisfying B>R), wherein:

the B levels of display output are represented by A bits of data, the bits of the A bits of data satisfy a relation of $R^0:R^1: \ldots R^m-n: \ldots$ (m being an integer not less than 2, and n being an integer not less than 1), in the step (a), weights of the data contributing to the outputs in the one frame period are set such that $R^A>B$ where B is a number of brightness levels displayable in the one frame period by a combination of A weights of instruction data being supplied to the electro-optic elements in the one frame period, and each difference in brightness between adjacent brightness levels among the B brightness levels is the same.

16. A weight determination method in a driving device for driving an electro-optic device including electro-optic elements capable of outputting R gradations of brightness (R being an integer not less than 2) provided for each combination of a plurality of scanning lines and at least one data line, the driving device including a driving section for supplying instruction data to the electro-optic elements corresponding to the scanning line currently selected among the plurality of scanning lines sequentially selected, the driving section supplying the instruction data to the electro-optic elements via the data lines corresponding to the electro-optic elements, the instructions data for controlling outputs of the electro-optic elements for a period until subsequent instruction data is supplied, the driving section supplying instruction data P1 through PA (A being an integer not less than 2) in one frame period for each electro-optic element so as to control outputs in the one frame period performed as output operation of the electro-optic elements over the one frame period, and selecting the scanning lines so that each of the instruction data P1 through PA appears once in the instruction data to be sequentially supplied to the data line, the method comprising the steps of:

(a) carrying out initialization by setting weights of the instruction data contributing to the one frame period so that a given bit data has a weight of R times of a weight of an immediately preceding bit data, when the instruction data are aligned in order of smaller to greater weight; and (b) providing a predetermined selection time as a selection time for starting the output period of a first instruction data in order of smaller to greater weight;

(c) determining a length of the output period appropriate for the instruction data according to the weight of the instruction data, and providing the selection time for starting the output period of a next instruction data by using the selection time at a time when the output period is terminated, the step (c) being repeated until all of the instruction data are provided with the selection time;

(d) judging whether or not the selection time thus provided to the next instruction data is identical to the selection time which has been provided before; and when it is judged that the selection time is the same as the selection time which has been provided before in the step (d), (e) adjusting the instruction data so that each of the instruction data, including the instruction data which have already been provided with the selection time and the instruction data which is to be provided with the selection time next, has a different selection time, by reducing the weight of the instruction data whose length of the output period has been determined in or before the step (c).

17. The weight determination method in a driving device for driving an electro-optic device as set forth in claim 16, wherein the step (e) includes a step for changing order of the instruction data in a manner such that; before reducing the weight of the instruction data having a lower weight than the instruction data subjected to providing of the selection time, one of the instruction data which have not been provided with the selection time is allotted as the next instruction data, which is to be provided with the selection time next, so that each of the instruction data, including the instruction data which have already been provided with the selection time and the instruction data which is to be provided with the selection time next, has a different selection time.

18. A driving device for driving an electro-optic device including a plurality of electro-optic elements capable of R-gradation display (R being an integer not less than 2) according to gradation data, comprising:

a driving section for supplying data to each of the electro-optic elements A times in each frame period in a time divisional manner, and for selecting the electro-optic elements so as to satisfy $R^A>B$, where B is a number of brightness levels displayable in one frame period, wherein each difference in brightness between adjacent brightness levels among the B brightness levels is the same and wherein data having different, non-numerically-ordered weights are applied to electro-optic elements in A consecutive selection times of the one frame period.

19. The driving device for driving an electro-optic device as set forth in claim 18, wherein:

the weight of the gradation data is determined according to a length of an output period, which is a period from a time at which a given gradation data is supplied to a time at which a next gradation data is supplied.

20. A display device comprising:

electro-optic display elements arranged in a matrix, each electro-optic display element capable of outputting R gradation levels; and a driving section for writing data to the electro-optic display elements A times during a frame period in accordance with data having A bits, each bit having a corresponding weight indicative of a time for which that bit is written to the electro-optic elements, so that B equally spaced-apart gradation levels can be displayed by the electro-optic display elements, wherein R is an integer not less than 2, A is an integer not less than 2, B>R and $R^A>B$, and wherein the bits are written to the electro-optic display elements such that the weight of at least one bit of the instruction data in each frame period is different from the weight of an immediately previous bit and different from the weight of an immediately subsequent bit.

21. The electro-optic display as set forth in claim 20, wherein the electro-optic display elements comprise liquid crystal display elements.

22. The electro-optic display as set forth in claim 20, wherein the electro-optic display elements comprise light-emitting diode elements.

23. The electro-optic display as set forth in claim 20, wherein the weight ratio of the A bits is given by $R^0:R^1:\ldots R^m-n:\ldots$, wherein m is an integer not less than 2 and n is an integer not less than 1.

24. The driving device as set forth in claim 1, wherein the order of the different weights applied to the electro-optic elements in A consecutive selection times of the frame period is non-numerical.

25. The display device as set forth in claim 7, wherein the order of the different weights applied to the electro-optic elements in A consecutive selection times of the frame period is non-numerical.

26. The driving method as set forth in claim 14, wherein the order of the different weights applied to the electro-optic elements in A consecutive selection times of the frame period is non-numerical.

27. The display device as set forth in claim 20, wherein the ratio of weights between two adjacent ones of the A bits is $G:G\times R-n$, where G is the weight of a first of the two adjacent ones of A bits and n is an integer not less than 1 and not more than $G\times(R-1)$.

* * * * *